US010481530B2

(12) United States Patent
Saitoh et al.

(10) Patent No.: US 10,481,530 B2
(45) Date of Patent: Nov. 19, 2019

(54) SEPARATION MEMBER, SEPARATION DEVICE, FIXING DEVICE, AND IMAGE FORMING APPARATUS

(71) Applicant: RICOH COMPANY, LTD., Tokyo (JP)

(72) Inventors: Seiji Saitoh, Kanagawa (JP); Keisuke Kubota, Kanagawa (JP); Masami Okamoto, Kanagawa (JP); Kenji Nozawa, Kanagawa (JP); Fumihiro Hirose, Kanagawa (JP); Kensuke Yamaji, Kanagawa (JP); Shuutaroh Yuasa, Kanagawa (JP); Yuuki Kikushima, Kanagawa (JP); Kaori Hemmi, Kanagawa (JP); Yuuta Kanda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/010,625

(22) Filed: Jun. 18, 2018

(65) Prior Publication Data

US 2018/0299809 A1 Oct. 18, 2018

Related U.S. Application Data

(63) Continuation of application No. PCT/JP2016/088771, filed on Dec. 26, 2016.

(30) Foreign Application Priority Data

Jan. 15, 2016 (JP) ..... 2016-006528
Jun. 10, 2016 (JP) ..... 2016-116321

(51) Int. Cl.
*G03G 15/20* (2006.01)
*G03G 15/00* (2006.01)

(52) U.S. Cl.
CPC ..... *G03G 15/2028* (2013.01); *G03G 15/20* (2013.01); *G03G 15/6532* (2013.01)

(58) Field of Classification Search
None
See application file for complete search history.

(56) References Cited

U.S. PATENT DOCUMENTS 4,929,983 A * 5/1990 Barton ..... G03G 15/2028 271/307
6,029,038 A 2/2000 Uehara et al.
(Continued)

FOREIGN PATENT DOCUMENTS

JP 01059277 A * 3/1989
JP 2006-189688 7/2006
(Continued)

OTHER PUBLICATIONS

English machine translation of JP01059277A.*
(Continued)

*Primary Examiner* — Clayton E. LaBalle
*Assistant Examiner* — Geoffrey T Evans
(74) *Attorney, Agent, or Firm* — Xsensus LLP

(57) ABSTRACT

A separation member that is used to separate a conveyance object from two rotation members, the conveyance object having been sent out from a nip that is formed by the two rotation members that are in contact with one another, the separation member includes a wavy part directed toward the nip and inclined from a normal to a center line of the two rotation members at a predetermined angle. The wavy part covers a contact zone where the conveyance object can come into contact with the separation member along a conveyance direction and along a width direction of the conveyance object, and the wavy part has a plurality of depressions parallel to each other and extending in a direc-
(Continued)

tion inclined from the conveyance direction and inclined from the width direction, at least two of the depressions overlapping along the conveyance direction.

15 Claims, 22 Drawing Sheets

(56) References Cited

U.S. PATENT DOCUMENTS

| | | | | |
|---|---|---|---|---|
| 7,890,039 | B2 | 2/2011 | Yamada | |
| 8,249,491 | B2 | 8/2012 | Hirose et al. | |
| 8,553,238 | B2 | 10/2013 | Hirose et al. | |
| 8,577,270 | B2 | 11/2013 | Hirose et al. | |
| 8,666,296 | B2 | 3/2014 | Yamamoto et al. | |
| 8,807,560 | B2 * | 8/2014 | Hironaka | B41J 13/00 271/264 |
| 8,903,290 | B2 | 12/2014 | Mikutsu | |
| 8,953,991 | B2 | 2/2015 | Ueno et al. | |
| 9,008,558 | B2 | 4/2015 | Saito et al. | |
| 9,026,024 | B2 | 5/2015 | Ogawa et al. | |
| 9,031,483 | B2 | 5/2015 | Yamamoto et al. | |
| 9,063,480 | B2 | 6/2015 | Yoshiura et al. | |
| 9,268,276 | B2 | 2/2016 | Hirose et al. | |
| 9,316,979 | B2 | 4/2016 | Nozawa et al. | |
| 9,389,560 | B2 | 7/2016 | Hirose et al. | |
| 9,405,250 | B2 | 8/2016 | Ogawa et al. | |
| 9,494,896 | B2 | 11/2016 | Yamaji et al. | |
| 9,494,904 | B2 | 11/2016 | Watanabe et al. | |
| 9,733,600 | B2 | 8/2017 | Nozawa et al. | |
| 9,740,147 | B2 * | 8/2017 | Fujiwara | G03G 15/2028 |
| 2004/0146323 | A1 * | 7/2004 | Fujisawa | G03G 15/2028 399/323 |
| 2013/0236225 | A1 | 9/2013 | Ogawa et al. | |
| 2016/0139549 | A1 | 5/2016 | Nozawa et al. | |
| 2016/0209789 | A1 | 7/2016 | Nozawa et al. | |

FOREIGN PATENT DOCUMENTS

| | | |
|---|---|---|
| JP | 2006-308783 | 11/2006 |
| JP | 2007047379 A | 2/2007 |
| JP | 2009-116298 | 5/2009 |
| JP | 2011008103 A | 1/2011 |
| JP | 2013-105009 | 5/2013 |
| JP | 2013-134290 | 7/2013 |
| JP | 2013186328 A | 9/2013 |
| JP | 5332310 | 11/2013 |
| JP | 2014-157215 | 8/2014 |
| JP | 2016-118785 | 6/2016 |
| JP | 2017-016077 | 1/2017 |
| WO | WO 2016/098879 A1 | 6/2016 |

OTHER PUBLICATIONS

English machine translation of JP2009116298A.*
International Search Report dated Mar. 28, 2017 in PCT/JP2016/088771 filed on Dec. 26, 2016 (with English Translation).
Written Opinion dated Mar. 28, 2017 in PCT/JP2016/088771 filed on Dec. 26, 2016.
Extended European Search Report dated Nov. 6, 2018 in Patent Application No. 16885126.9, 10 pages.
Japanese Office Action dated Mar. 12, 2019, issued in corresponding JP Application No. 2017-561571, 6 pages.

* cited by examiner

SEPARATION MEMBER, SEPARATION DEVICE, FIXING DEVICE, AND IMAGE FORMING APPARATUS

CROSS-REFERENCE TO RELATED APPLICATIONS

The present patent application is a continuation application of International Application No. PCT/JP2016/088771, filed Dec. 26, 2016, which claims priority to Japanese Patent Application No. 2016-006528, filed Jan. 15, 2016, and Japanese Patent Application No. 2016-116321, filed Jun. 10, 2016. The contents of these three applications are incorporated herein by reference in their entirety.

FIELD OF THE INVENTION

The present invention relates to a separation member, a separation device, a fixing device, and an image forming apparatus.

BACKGROUND ART

A fixing device is known in which, as a result of a recording medium passing through a nip formed by two rollers, a toner carried on the recording medium is melted and pressed, and an image is fixed onto the recording medium.

In such a type of a fixing device, in order to surely prevent a recording medium having passed through a nip from being wound on a roller, such a configuration is known that a separation member having a separation claw or a separation plate is disposed near an exit of a nip, to strip off a leading end of a recording medium from a fixing member (for example, see Patent Documents Nos. 1 and 2, for example).

In an image forming apparatus that uses a toner for forming a visible image, a fixing device is installed for permanently fixing a toner image onto a recording medium such as a transfer sheet or the like.

In the fixing device, a recording medium passes through a pressing device (a fixing nip) that is formed by a fixing roller or a fixing belt heated and rotated, a pressing roller or a pressing belt pressed onto the fixing roller or the fixing belt and rotated, and so forth. As a result, a toner carried on the recording medium is melted and a toner image is fixed onto the recording medium.

In this regard, a sheet separation device including a separation claw or a separation plate is installed near the fixing roller or the fixing belt. The recording medium that would be wound on the fixing roller or the fixing belt with the melted toner is forcibly separated by the sheet separation device.

In this regard, when the recording medium is forcibly separated from the fixing roller or the fixing belt, the toner image on the recording medium comes into contact with a conveyance surface of the separation claw or the separation plate. As a result, a streaked image may be generated or a conveyance resistance for the recording medium may increase.

In order to avoid generation of a streaked image, Patent Document No. 3 proposes that respective shapes of a conveyance surface of a separation claw at an end and at a center with respect to a width direction of the conveyance surface are different from one another. That is, the end projects from the conveyance surface and the center is recessed from the conveyance surface.

RELATED ART DOCUMENT

Patent Document

Patent Document No. 1: Japanese Patent No. 5332310

Patent Document No. 2: Japanese Unexamined Patent Application Publication No. 2014-157215

Patent Document No. 3: Japanese Unexamined Patent Application Publication No. 2006-189688

SUMMARY

In one aspect of the present invention, a separation member that is used to separate a conveyance object from two rotation members, the conveyance object having been sent out from a nip that is formed by the two rotation members that are in contact with one another. The separation member includes a wavy part directed toward the nip and inclined from a normal to a center line of the two rotation members at a predetermined angle. The wavy part covers a contact zone where the conveyance object can come into contact with the separation member along a conveyance direction and along a width direction of the conveyance object, and the wavy part has a plurality of depressions parallel to each other and extending in a direction inclined from the conveyance direction and inclined from the width direction, at least two of the depressions overlapping along the conveyance direction.

DESCRIPTION OF EMBODIMENTS

In the related arts described above, a toner on a recording medium may come into contact and be rubbed with a separation member in a state where the toner has heat of a fixing process and is in a semi-molten state, and thus, an image defect may occur.

Further, when a recording medium is forcibly separated from a fixing roller or a fixing belt, a toner image on the recording medium may come into contact with a conveyance surface of the separation claw or the separation plate. As a result, a streaked image may be generated or a conveyance resistance for the recording medium may increase.

Further, for a case where a recording medium is less rigid such as coat paper, a more severely streaked image may be generated because contact force applied to a separation claw is concentrated at an end, according to Patent Document No. 1.

In addition, as a result of a toner coming into contact with a conveyance surface of a separation claw or a separation plate, the toner may adhere to the separation claw or the separation plate. If adhering of a toner occurs, the adhering toner may function as conveyance resistance for the recording medium, and also, the adhering toner may scratch the toner image, and thus, a streaked image may be generated.

The embodiments of the present invention have been devised in consideration of these problems, and an object of the embodiments of the present invention is to provide a separation member that restrains occurrence of an image defect that may otherwise occur when a conveyance object is stripped off from a nip.

Another object of the embodiments of the present invention is to provide a separation device with which generation of a streaked image can be restrained even in a case where a less rigid recording medium is used.

According to the embodiments of the present invention, it is possible to restrain occurrence of an image defect that may otherwise occur when a conveyance object is stripped off from a nip.

Further, it is possible to restrain generation of a streaked image even when a less rigid recording medium is used.

First Embodiment

As one example of an embodiment of the present invention, an image forming apparatus 100 that is an electrophotographic color printer illustrated in FIG. 1 will now be described.

Figure 1:
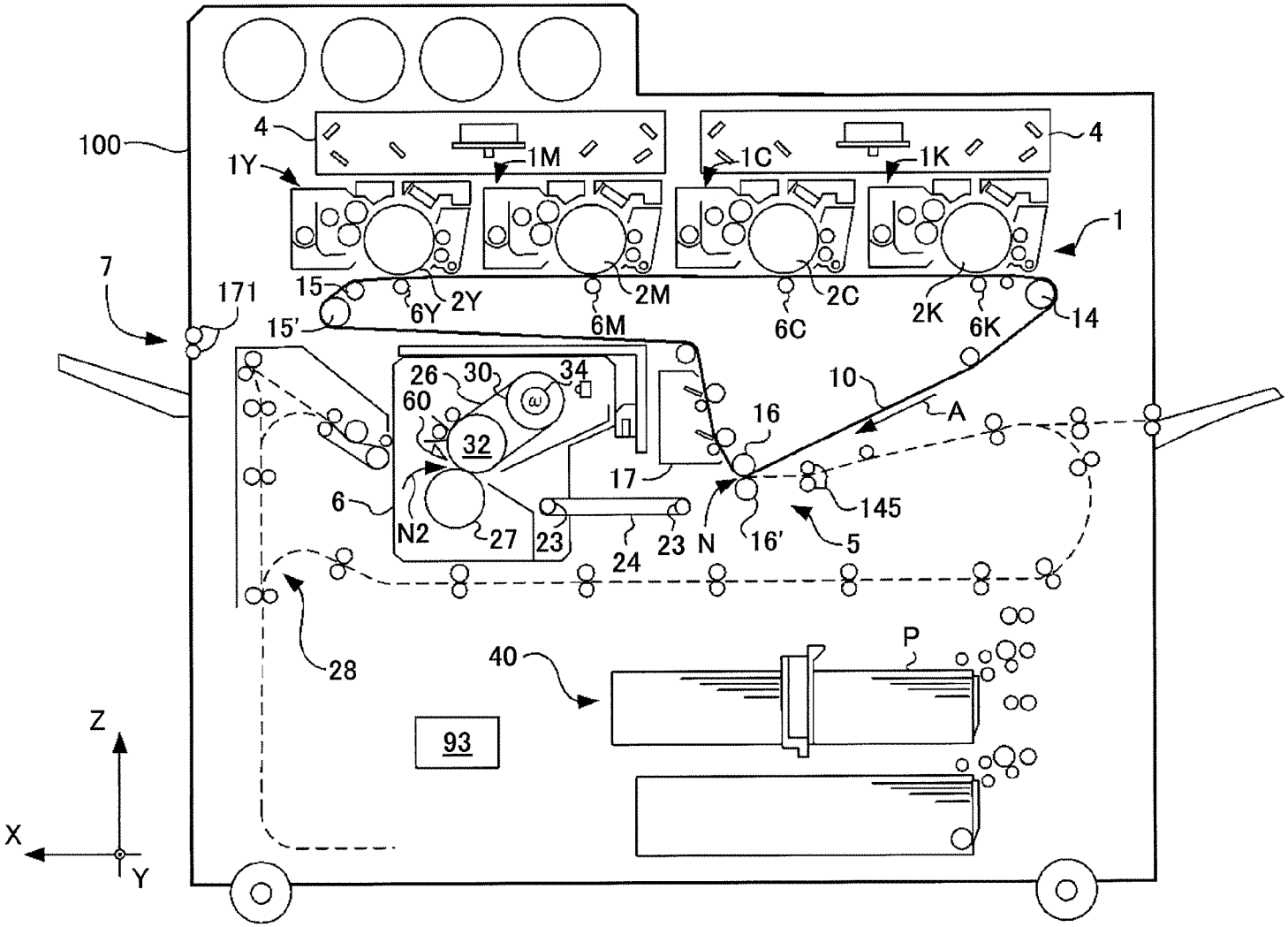
FIG. 1 illustrates one example of an overall configuration of an image forming apparatus according to an embodiment of the present invention.

Note that, in FIG. 1, it is assumed that an upward vertical direction of the image forming apparatus 100 is the Z direction, a direction perpendicular to the Z direction and also perpendicular to FIG. 1 is the Y direction, and a direction perpendicular to the Z direction and perpendicular to the Y direction is the X direction.

The image forming apparatus 100 is a printer of a tandem type and of an intermediate transfer type.

The image forming apparatus 100 includes an intermediate transfer belt 10 that is a transfer member in a form of an endless belt, an image forming device 1 that forms an image on the intermediate transfer belt 10, and a sheet feeding unit 40 disposed below the image forming apparatus 100 and supplying a sheet P that is a recording medium.

The image forming apparatus 100 includes the image forming device 1 that includes four image formation units 1Y, 1C, 1M, and 1K for forming an image on a sheet P, and exposure devices 4 that are optical writing units disposed above the image forming device 1.

The image forming apparatus 100 further includes a secondary transfer device 5 for conveying a sheet P and transferring a toner image carried by an intermediate transfer belt 10 onto the sheet P at a secondary transfer position N that is a nip between the intermediate transfer belt 10 and the sheet P.

The image forming apparatus 100 further includes a cleaning unit 17 that removes a toner that is left after secondary transferring, in other words, that cleans the intermediate transfer belt 10.

The image forming apparatus 100 further includes a registration roller pair 145 that sends a sheet P supplied from the sheet feeding unit 40 to the secondary transfer position N in predetermined timing.

The image forming apparatus 100 further includes a fixing device 6 that fixes a toner image onto a sheet P by heating and pressing the sheet P that has passed through the secondary transfer position N to carry the toner image and has been conveyed by the secondary transfer device 5.

The image forming apparatus 100 further includes a sheet ejection unit 7 that ejects, to the outside, a sheet P that has passed through the fixing device 6 to have a toner image fixed.

The image forming apparatus 100 further includes an image forming control device 93 as a control device for controlling operations of the respective elements mentioned above. In the image forming control device 93, a CPU, a volatile memory, and a nonvolatile memory are installed.

The intermediate transfer belt 10 is wound on a plurality of supporting rollers 14, 15, and 15', and a secondary transfer opposite roller 16; and is supported in such a manner that the intermediate transfer belt 10 can turn clockwise in a direction A illustrated in FIG. 1. The secondary transfer opposite roller 16 functions as one of the supporting rollers that support the intermediate transfer belt 10.

According to the present embodiment of the present invention, the supporting roller 14 in particular has a function as a driving roller to drive and turn the intermediate transfer belt 10.

The image forming device 1 of the tandem type is configured as follows: Along a conveyance direction of the intermediate transfer belt 10 illustrated as the direction A, four image formation units 1Y, 1M, 1C, and 1K are disposed side by side on the intermediate transfer belt 10 that is stretched between the supporting rollers 14 and 15. Note that letters Y, M, C, and K added to the end of reference signs respectively indicate colors of yellow, magenta, cyan, and black. The image formation units 1Y, 1M, 1C, and 1K respectively include photoconductor drums 2Y, 2M, 2C, and 2K as image carriers that carry toner images of the respective colors.

Around the photoconductor drums 2Y, 2M, 2C, and 2K, developing devices for developing with toners of the respective colors electrostatic latent images formed by the exposure devices 4 are installed. Detailed description of the developing devices is omitted.

Primary transfer rollers 6Y, 6M, 6C, and 6K are installed at primary transfer positions where toner images are transferred from the photoconductor drums 2Y, 2M, 2C, and 2K to the intermediate transfer belt 10 in such a manner that the primary transfer rollers 6Y, 6M, 6C, and 6K respectively face the photoconductor drums 2Y, 2M, 2C, and 2K with the intermediate transfer belt 10 in between.

The image formation units 1Y, 1M, 1C, and 1K can form toner images of desired colors on the intermediate transfer belt 10 by causing the photoconductor drums 2Y, 2M, 2C, and 2K to come into contact with and to be apart from the intermediate transfer belt 10.

The exposure devices 4 are optical scanning devices that form electrostatic latent images with the use of two types of scanning light, one type of which corresponds to the two image formation units 1Y and 1M and the other type of which corresponds to the two image formation units 1C and 1K.

The exposure devices 4 expose the photoconductor drums 2Y, 2M, 2C, and 2K according to respectively corresponding sets of image information of the colors of yellow, magenta, cyan, and black, to form electrostatic latent images.

According to the present embodiment of the present invention, the image forming apparatus 100 exposes the four photoconductor drums 2Y, 2M, 2C, 2K with the use of the exposure devices 4 that use the two types of scanning light. However, an embodiment of the present invention is not limited to the above-mentioned configuration. For example, the exposure devices 4 may be an optical scanning device that uses the four types of scanning light, or may be four optical scanning devices each using a single type of scanning light to expose the corresponding one of the photoconductor drums 2Y, 2M, 2C, and 2K.

The secondary transfer device 5 is installed on a side opposite the image forming device 1 with respect to the intermediate transfer belt 10. The secondary transfer device 5 presses the secondary transfer roller 16' onto the secondary transfer opposite roller 16 that is one of the supporting rollers that support the intermediate transfer belt 10; applies a transfer electric field; and thus, transfers an image on the intermediate transfer belt 10 to a sheet P that is a recording medium.

In other words, the secondary transfer device 5 sandwiches the intermediate transfer belt 10 and the sheet P with the secondary transfer roller 16' at the secondary transfer position N; applies a secondary transfer bias; and thus transfers a toner image onto the surface of the intermediate transfer belt 10 to the sheet P.

At this time, for the secondary transfer bias, charges opposite the electrostatic charges on the surface of the intermediate transfer belt 10 are applied.

The secondary transfer device 5 conveys a sheet P on which secondary transfer has been performed at the secondary transfer position N to the fixing device 6.

On the downstream side with respect to the conveyance direction of the secondary transfer device 5, the fixing device 6 that fixes a transferred image on a sheet P is installed.

Figure 2:
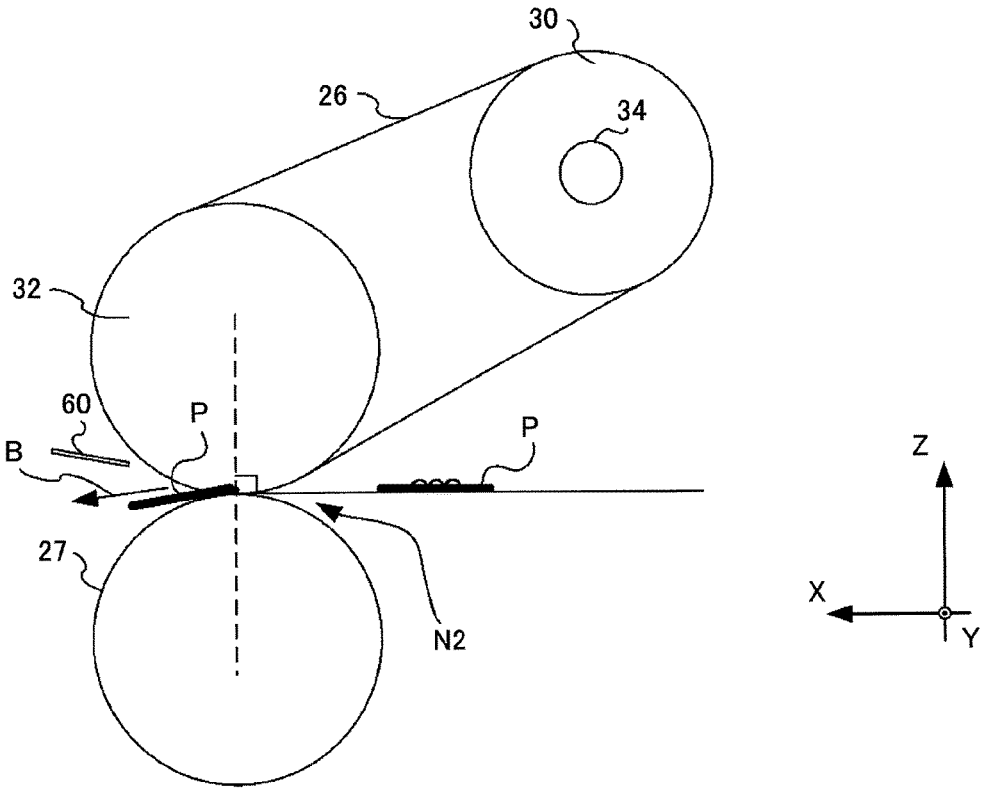
FIG. 2 illustrates one example of a fixing device illustrated in FIG. 1.

As illustrated in FIG. 2, the fixing device 6 includes a heating roller 30 that includes a heater 34 that is a heat source; a fixing belt 26 that is a rotation member and is wound on the heating roller 30; and a fixing roller 32. The fixing belt 26 is wound on the fixing roller 32 and the heating roller 30.

The fixing device 6 further includes a pressing roller 27 that is a rotation member pressed onto the fixing belt 26 to form a fixing nip N2 that is a pressing device between the pressing roller 26 and the fixing roller 32. The heating roller 30, the fixing belt 26, and the fixing roller 32 are rotation members constituting a belt unit for moving the fixing belt 26 in an endless manner.

In the present embodiment of the present invention, the fixing roller 32 and the pressing roller 27 are arranged in such a manner that a normal to a center line that connects a center of rotation of the fixing roller 32, which is a rotation member, with a center of rotation of the pressing roller 27 is parallel to an X-Y plane.

The fixing device 6 includes a separation device 60 installed on the downstream side of the fixing nip N2 with respect to the conveyance direction.

The fixing device 6 causes a sheet P carrying a toner image to pass through the fixing nip N2 to fix the toner image to a surface of the sheet P by the effects of heat and pressure.

The fixing belt 26 is an endless belt having, for example, a multilayer structure where, on a base layer made of a PI (polyimide) resin having a thickness of 90 μm, an elastic layer made of a silicone rubber or the like and a release layer are sequentially stacked.

The elastic layer of the fixing belt 26 has a thickness in an approximate range of from 200 μm through 500 μm, and is made of an elastic material such as a silicone rubber, a fluororubber, or an expanded silicone rubber.

The release layer of the fixing belt 26 has an approximate thickness of 20 μm, and is made of a PFA (tetrafluoroethylene perfluoroalkylvinylether copolymer resin), a polyimide, a polyetherimide, PES (polyether sulfide), or the like.

By installing the release layer as a surface layer of the fixing belt 26, it is possible to ensure releasability (detachability) with respect to a toner (a toner image).

The heating roller 30 is, for example, a thin-walled cylinder made of a metal such as aluminum, and includes the heater 34 that is a halogen heater inside the cylinder.

The fixing roller 32 and the pressing roller 27 are cylinders where, on metallic cored bars, elastic layers made of a fluororubber, a silicone rubber, an expanded silicone rubber, or the like are formed.

The heating roller 30 heats the fixing belt 26, thus, heat is supplied to an unfixed toner image on a sheet P when the sheet P passes through the fixing nip N2, and the toner image is fixed to an image-forming-side surface of the sheet P.

On the downstream side of the fixing nip N2 with respect to the conveyance direction, the separation device 60 is disposed on the fixing roller 32 side.

Figure 3:
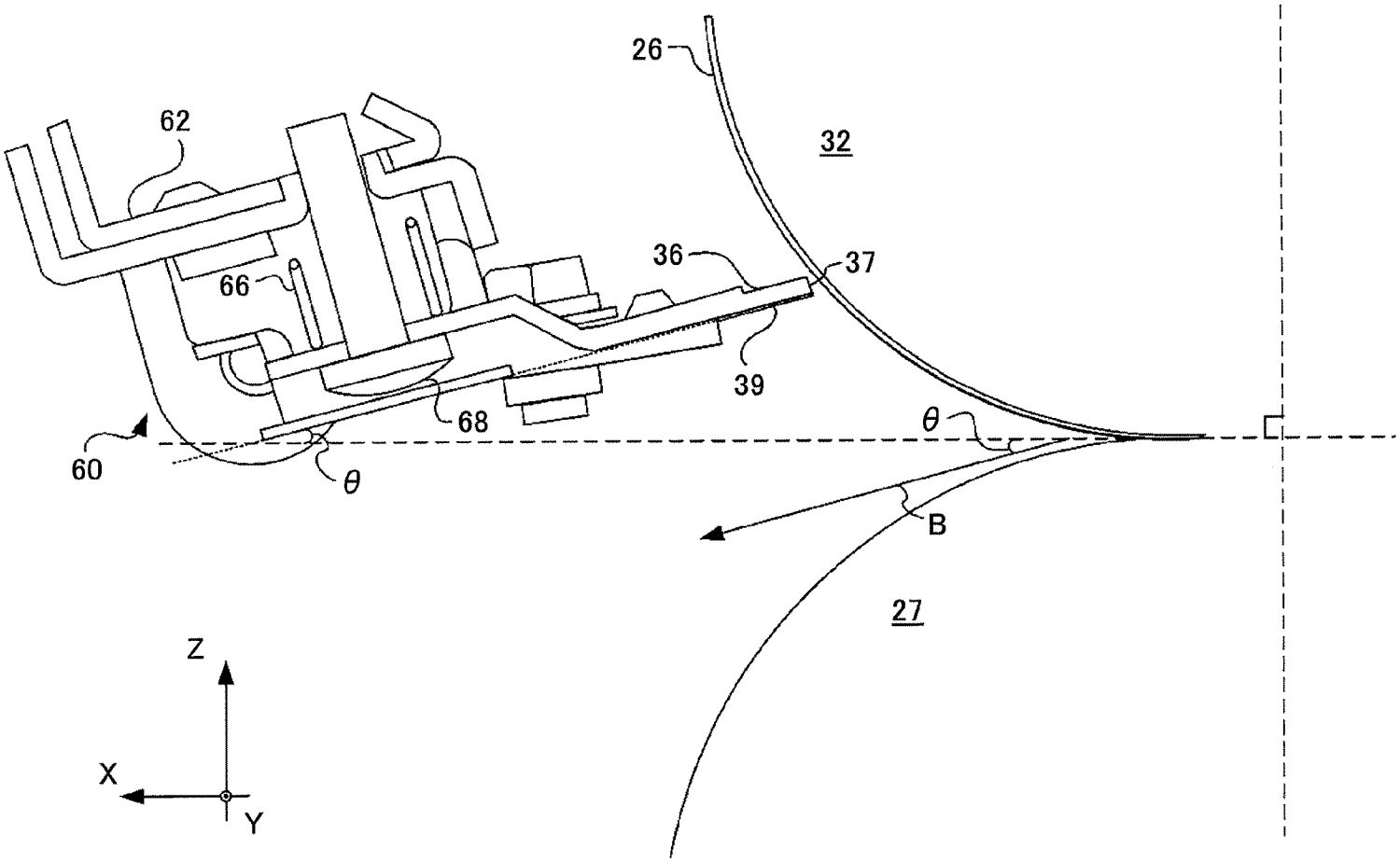
FIG. 3 illustrates one example of an overall configuration of a separation device according to the embodiment of the present invention.

The leading end of a sheet P that has passed through the fixing nip N2 is stripped off from the fixing belt 26 by a separation member 36, and the sheet P is conveyed to the sheet ejection unit 7. The separation member 36 installed in the separation device 60 as illustrated in FIG. 3 will be described later. The sheet P is a recording medium and is a conveyance object.

Alternatively, the sheet P is sent to a sheet inverting unit 28 that conveys the sheet P toward a registration roller pair 145 for inverting the sheet P upside down in order that images will be formed on both sides.

Note that it is desirable that the separation device 60 may be installed on the image forming side of a sheet P, i.e., on the fixing roller 32 side. However, the separation device 60 may be disposed on the pressing roller 27 side.

The sheet ejection unit 7 includes a pair of sheet ejection rollers 171 facing one another.

The image forming control device 93 includes a CPU (Central Processing Unit), a main memory (MEM-P), a north bridge (NB), and a south bridge (SB).

The image forming control device 93 further includes an AGP (Accelerated Graphics Port) bus, an ASIC (Application Specific Integrated Circuit), and a local memory (MEM-C).

The image forming control device 93 further includes a HD (Hard Disk), a HDD (Hard Disk Drive), a PCI bus, and a network I/F.

The CPU operates according to programs stored in the main memory to process or calculate data or to control the above-described elements. The main memory is used as a storage area of the image forming control device 93, and stores the programs and data for implementing various functions of the image forming control device 93. The programs may be provided as files of an installable or executable form after being stored in a computer readable recording medium such as a CD-ROM, a FD, a CD-R, a DVD, or the like.

The local memory (MEM-C) is used as an image buffer for a photocopying process and is used as a code buffer. The HD is a storage storing image data, font data used for printing, and forms. The HDD controls reading data from and writing data to the HD under the control of the CPU. The network I/F is used to transmit information to and receiving information from an external apparatus such as an information processing apparatus via a communication network.

The image forming control device 93 operates as a communication control device for controlling bidirectional communication with a host apparatus (for example, a personal computer) via a communication network or the like.

The image forming control device 93 operates also as an image data processing device for transmitting image data from a host apparatus to the exposure devices 4.

A sheet P to which an image is transferred by the secondary transfer device 5 is sent to the fixing device 6 by a conveyance belt 24 supported by two rollers 23. In this regard, instead of the conveyance belt 24, a fixed guide member may be used. Further alternatively, conveyance rollers, or the like, may be used.

In the illustrated example, the sheet inverting unit 28 is installed, below the secondary transfer device 5 and the fixing device 6 and in parallel to the image forming device 1, for inverting and conveying a sheet P for the purpose of recording an image on the other side to implement both-side printing.

The separation device 60 accompanied by the fixing device 6 in the image forming apparatus 100 and having the above-described configuration will now be described in more detail with reference to FIGS. 3 and 4.

The separation device 60 includes a stay 62 as a supporting member fixed to a body of the image forming apparatus 100, a separation member 36 installed to the stay 62 with screws 68, and springs 66 used to adjust the distance of the separation member 36 from the stay 62 to position the separation member 36 with respect to the Z direction.

Figure 4:
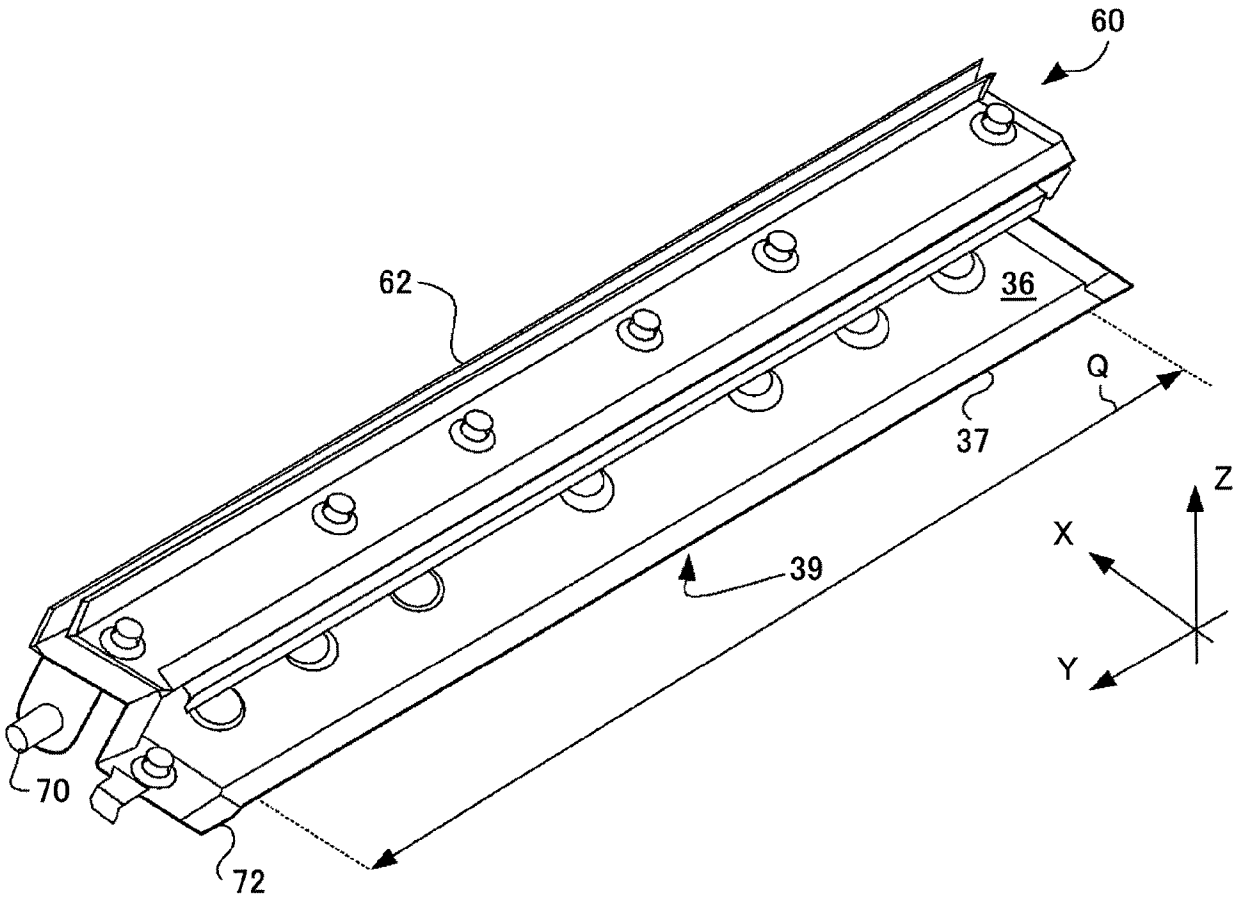
FIG. 4 is a perspective view illustrating one example of a configuration of the separation device illustrated in FIG. 3.

As illustrated in FIG. 4, the stay 62 has positioning pins 70 formed by a swaging process at both ends with respect to the Y direction of a sheet P. The stay 62 is fixed to the body of the image forming apparatus 100 with the positioning pins 70 in a mating manner.

A plurality of the screws 68 and a plurality of the springs 66 are arranged side by side along the Y direction of the separation member 36 and have a function as a position adjustment unit to adjust the distance along the Z direction between the stay 62 and the separation member 36.

Figure 5:
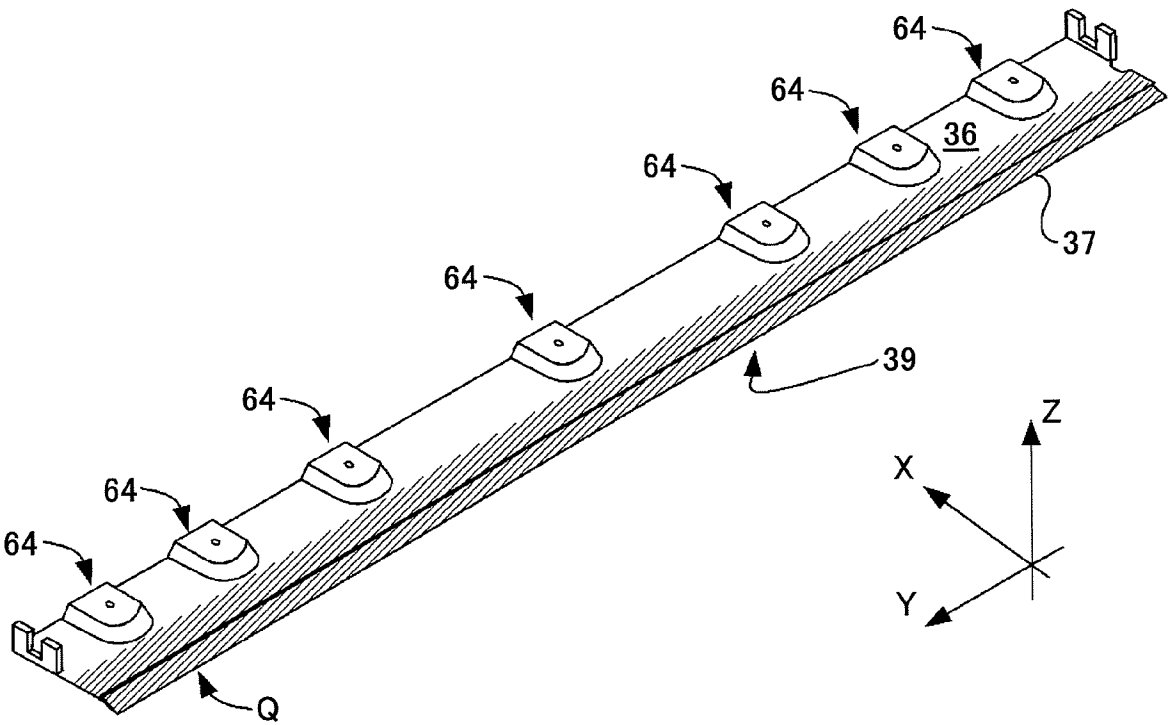
FIG. 5 illustrates one example of a configuration of a separation member of the separation device illustrated in FIG. 3.

According to the present embodiment of the present invention, the separation member 36 is a single flat member extending along the Y direction as illustrated in FIG. 5, and has a plurality of projections 64 projecting in the +Z direction and a wavy part 39 formed to cover a zone that can come into contact with a sheet P on the −Z side surface of the separation member 36.

It is desirable that the separation member 36 may be formed of a single flat member integrally formed along the Y direction perpendicular to the conveyance direction in order that the separation member 36 can come into contact with a sheet P evenly.

The separation member 36 has a length greater than or equal to the length of the maximum image area of a sheet P along the Y direction, which is the same direction as the width direction of the fixing belt 26. The maximum image area in particular means the maximum area for which an image can be formed on a sheet P.

The separation member 36 may be a plurality of narrow separation claws arranged side by side along the Y direction.

The body of the separation member 36 is made of a heat-resistant plastic plate or a metallic plate such as a SUS. It is desirable that an edge 37 that is an extending end of the body in the −X direction may be like a thin sheet having a thickness of 0.4 mm so that the distance from the fixing nip N2 can be reduced.

Further, as illustrated in FIG. 4, abutting plates 72 are formed at ends of the stay 62 in the ±Y directions outside both ends of the separation member 36. In more detail, the abutting plates 72 are formed outside a sheet passing zone Q.

Hereinafter, a zone where the separation member 36 and a sheet P can come into contact on the −Z side surface of the separation member 36 will be referred to as the sheet passing zone Q.

Abutting ends 72*a* of the abutting plates 72 come into contact with both ends of the fixing belt 26 with respect to the ±Y directions so that the abutting plates 72 position the separation member 36.

Figure 6:
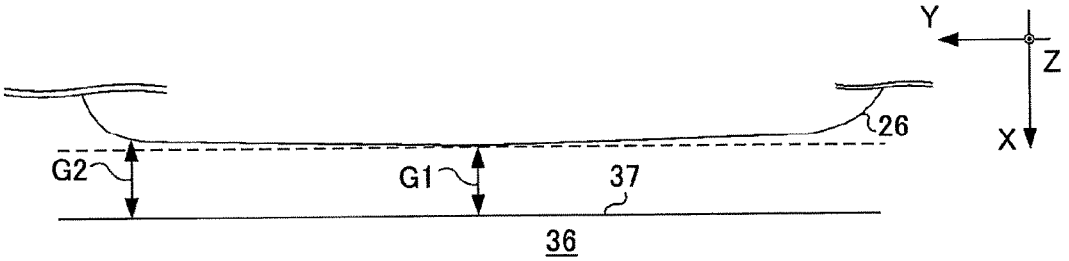
FIG. 6 illustrates one example of a gap between the separation member and a fixing belt.

In the image forming apparatus 100 in which the center of a sheet P along the Y direction is used as a reference position for conveying the sheet P, it is desirable that the gaps G1 and G2 between the edge 37 and the fixing belt 26 may be adjusted in such a manner that the gap at an end of the separation member 36 with respect to the Y direction is greater than the gap at the center of the separation member 36 with respect to the Y direction, as illustrated in FIG. 6.

In other words, the gap G1 between the edge 37 and the fixing belt 26 at the center of the separation member 36 with respect to the Y direction is shorter than the gap G2 between the edge 37 and the fixing belt 26 at an end of the separation member 36 with respect to the Y direction. In this regard, in FIG. 6, for the sake of explanation, illustration is made exaggeratingly and the scale is different from the actual scale.

The outer shape of the fixing roller 32 changes due to thermal expansion when the fixing roller 32 is heated. When a sheet P is conveyed in such a manner that the center of the sheet P with respect to the Y direction is used as the reference position, it is desirable that the edge 37 may be supported in such a manner that, when the fixing roller 32 is expanded thermally with respect to the center of the Y direction, the edge 37 of the separation member 36 is parallel to the fixing roller 32.

That is, it is desirable that the gap may be smallest at the center of a sheet P that is used as the reference position for conveying the sheet P.

Figure 7:
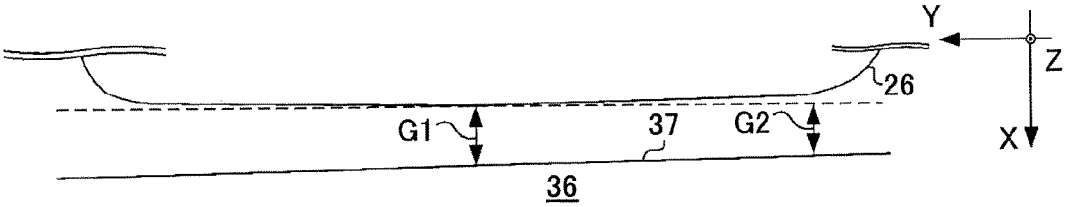
FIG. 7 illustrates another example of the gap between the separation member and the fixing belt.

For a case of an end reference conveyance system where an end of a sheet P in the −Y direction is used as the reference position, the reference position of thermal expansion is the end of the fixing roller 32 in the −Y direction. Therefore, as illustrated in FIG. 7, the edge 37 is supported in a manner of being inclined from the axis of the fixing roller 32, i.e., from the Y direction.

An end of the separation member 36 adjacent to the fixing nip N2, i.e., the edge 37 is disposed in a manner of being inclined with respect to an X-Y plane by an angle θ, as illustrated in FIG. 3.

It is generally desirable that the fixing nip N2 formed by the fixing roller 32 and the pressing roller 27 may be formed in such a manner that the conveyance direction B of the fixing nip N2 is directed toward the image-not-formed side, i.e., the −Z direction corresponding to the pressing roller 27 side in order that a sheet P can be easily separated from the fixing belt 26.

The present embodiment of the present invention is designed in such a manner that the pressing roller 27 is harder than the fixing roller 32 so as to incline the B direction that is the conveyance direction toward the pressing roller 27 side from an X-Y plane.

Figure 8:
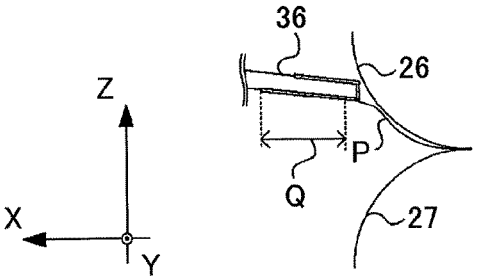
FIG. 8 illustrates one example of an operation performed when the separation member strips off a sheet.

However, for example, when a solid image has been formed at a leading end area of a thin sheet P, the sheet P may be wound on the fixing belt 26, and may be conveyed in a state of adhering to the fixing belt 26, as illustrated in FIG. 8.

Figure 9A:
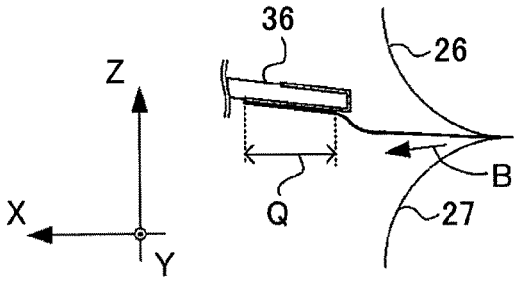
FIG. 9A is a schematic diagram illustrating one example of a manner of stripping off a sheet according to the embodiment of the present invention.
Figure 9B:
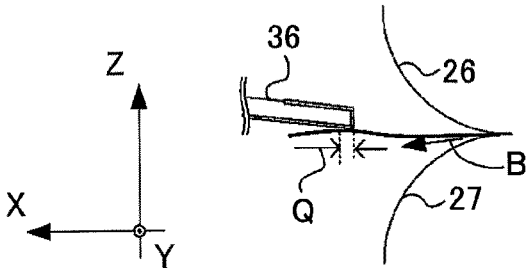
FIG. 9B is a schematic diagram illustrating one example of a manner of stripping off a sheet according to the embodiment of the present invention.
Figure 9C:
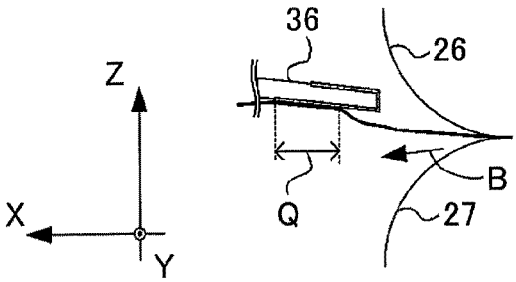
FIG. 9C is a schematic diagram illustrating one example of a manner of stripping off a sheet according to the embodiment of the present invention.
Figure 9D:
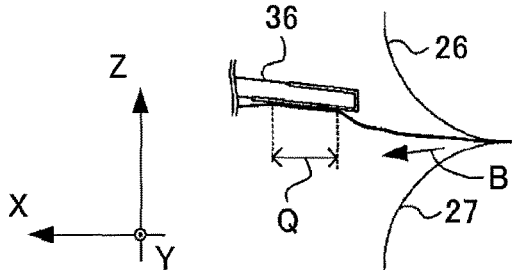
FIG. 9D is a schematic diagram illustrating one example of a manner of stripping off a sheet according to the embodiment of the present invention.

When a sheet P is thick, the toughness of the sheet P exceeds the adherence force of the toner toward the fixing belt 26, and the sheet P is ejected in the direction of the fixing nip N2, i.e., in the B direction, as illustrated in FIG. 9B.

Even in such a case, as a result of the edge 37 of the separation member 36 being inclined by the angle θ with respect to an X-Y plane, excessive contact of a sheet P with the separation member 36 is avoided, and occurrence of an image defect is restrained.

It is desirable that the angle θ may be inclined toward the image-not-formed side with respect to a normal to the center line of the two rotation members that form the fixing nip N2, in other words, may be inclined toward the pressing roller 27 side by an angle within a range of from 0 degrees through 10 degrees.

In other words, it is desirable that the installation angle θ of the separation member 36 may be such that the separation member 36 is installed parallel to the conveyance direction B of a sheet P.

By thus making the angle θ same as the direction of the fixing nip N2, the separation member 36 is disposed along the conveyance direction B of a sheet P, and thus, occurrence of an image defect that may otherwise occur due to excessive contact with the separation member 36 is restrained.

Further, thanks to the above-mentioned disposition of the separation member 36, it is easy for the edge 37 to strip off a sheet P from the fixing belt 26 even for a case where the sheet P has been conveyed in a state of being wound on the fixing belt 26.

There may be various possible sheet conveyance states depending on a state of an image being formed on a sheet P, a type of a sheet P, and so forth, as illustrated in FIGS. 9A-9D. In any state of these possible sheet conveyance states, as illustrated in FIGS. 9A-9D, the separation member 36 strips off a sheet P from the fixing belt 26. In this regard, zones where the separation member 36 and a sheet P come into contact with are different for the respective cases, and therefore, the sheet passing zones Q for the respective cases are illustrated in the figures.

As already described above, it is desirable that the wavy part 39 may be formed to include the sheet passing zone Q. For a case where various conveyance states may occur, it is more desirable that the wavy part 39 may be formed to include the greatest sheet passing zone Q.

The separation member 36 having the above-described configuration strips off a sheet P from the fixing belt 26 by coming into contact with the sheet P.

In this regard, the toner on a sheet P is in a state of being soft and deformable immediately after the sheet has passed through the fixing nip N2 because it is immediately after the toner is heated and pressed.

If the sheet passing zone Q of the separation member 36 comes into contact with such a toner, the toner may be deformed and an image defect may occur.

Figure 17A:
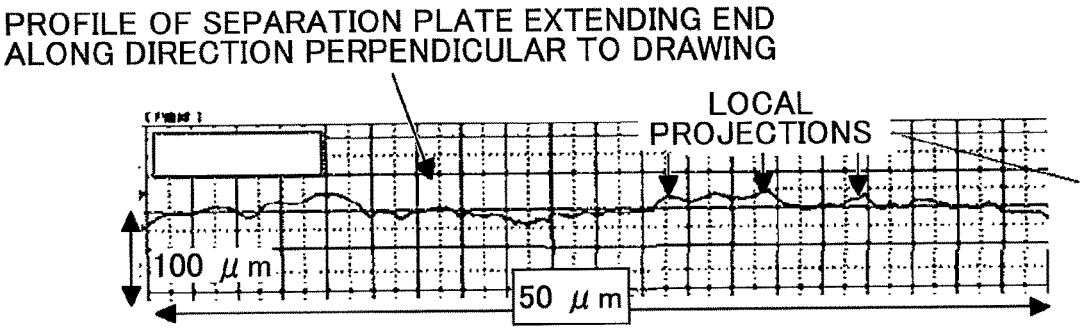
FIG. 17A illustrates a conventional example comparative to the second embodiment of the present invention.

FIG. 17A illustrates a graph of a Z-direction surface state of a separation member 36 as a comparison example for a case where a surface of the separation member 36 has local projections. A segment corresponding to the surface state illustrated in FIG. 17A is illustrated in FIG. 17B as an area C enclosed by a broken line.

Figure 17B:
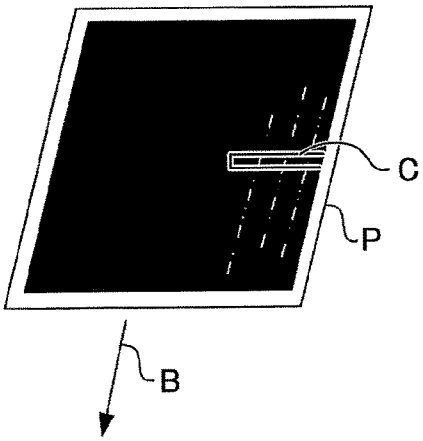
FIG. 17B illustrates a conventional example comparative to the second embodiment of the present invention.

Concerning such an image defect problem, it is known that an image defect such as luster streaks appearing in a solid image formed on a sheet P as illustrated in FIG. 17B may be likely to occur especially when a separation member 36 has a rough surface state as illustrated in FIG. 17A.

In order to solve the problem, a surface of a separation member 36 might be smoothed, for example. However, if a surface of a separation member 36 were smoothed, adhesion between the separation member 36 and a sheet P would be enhanced, and thus, conveyance of the sheet P might be adversely affected.

Figure 10:
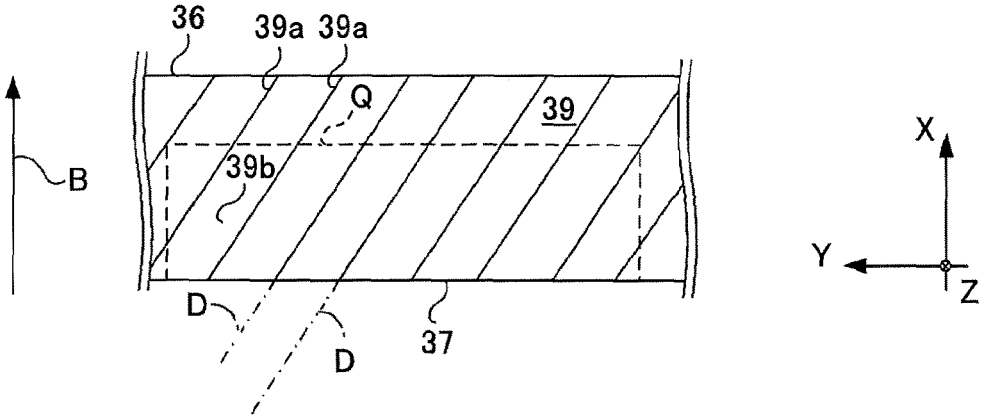
FIG. 10 illustrates one example of a wavy part according to the embodiment of the present invention.

Therefore, according to the present embodiment of the present invention, the separation member 36 includes a wavy part 39 having a plurality of depressions 39*a* that are mutually parallel and extend along a direction inclined from the B direction and also inclined from the Y direction as illustrated in FIG. 10.

The wavy part 39 will now be described in detail.

Figure 11:
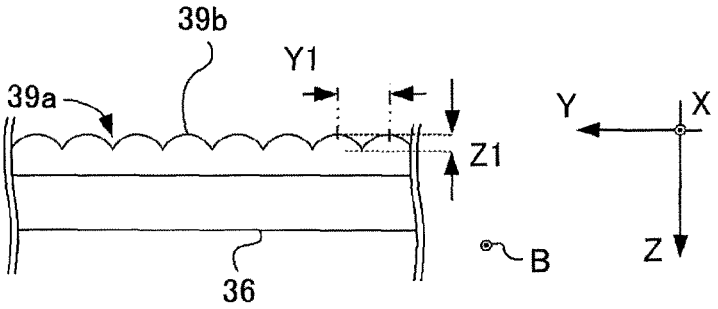
FIG. 11 is a sectional view illustrating one example of a sectional configuration of the wavy part according to the embodiment of the present invention.

As illustrated in FIGS. 10 and 11, the wavy part 39 has grooves 39*a* as the plurality of depressions inclined from the B direction and also inclined from the Y direction; and projections 39*b* formed between the grooves 39*a*.

The grooves 39*a* are fine depressions formed at intervals Y1 as schematically illustrated in FIG. 11 as a sectional view.

It is desirable that the projections 39*b* may be formed between the grooves 39*a* in a manner of projecting to have smoothly curved surfaces.

Further, the grooves 39*a* are formed in such a manner that at least two of the grooves 39*a* overlap along the B direction.

The grooves 39*a* "overlap" means that, when the separation member 36 is viewed along the B direction, it is seen that at least two of the grooves 39*a* overlap as illustrated in FIG. 10.

In other words, when a virtual straight line is drawn along the B direction in the wavy part 39, the straight line crosses the grooves 39*a* at two or more points.

In further other words, as illustrated in FIG. 10, straight lines D that are elongated lines or extending lines of the grooves 39*a* of the wavy part 39 extend obliquely to the B direction, that is, the straight lines D extend along an oblique direction. Thus, the respective elongated lines of the adjacent grooves 39*a* have segments that overlap for a direction perpendicular to the B direction.

The extending lines are lines appearing on a surface of the separation member 36 due to the presence of the grooves 39*a* formed at the edge 37 of the separation device 60.

As a result of the extending lines of the grooves 39*a* being oblique to the B direction, the plurality of the projections 39*b* between the extending lines of the grooves 39*a* evenly come into contact with the same positions on a sheet P. Thus, it is possible to restrain generation of pitch-like streaks illustrated in FIG. 17B or the like.

The degree of the inclination to the B direction may be any one of various angles such as 30 degrees, 45 degrees and 60 degrees. It is desirable that the degree of the inclination may fall within a range such that adjacent grooves 39*a* overlap along the B direction. In a case where the inclination is at 45 degrees, an overlap occurs along the B direction, and also an overlap occurs along a direction perpendicular to the B direction. Therefore, the inclination at 45 degrees is most desirable.

The grooves 39*a* may be formed for a length of 2 mm, or of 5 mm or more along the B direction. It is most desirable that the grooves 39*a* may be formed to cover a zone where a sheet P can come into contact with the separation member 36, i.e., a sheet passing zone Q.

In the wavy part 39 illustrated in FIG. 10, the grooves 39*a* are formed as simple oblique lines. However, the grooves 39*a* may be formed to have, for example, wedge shapes, shapes of >, or shapes of a letter such as X or C.

Figure 18:
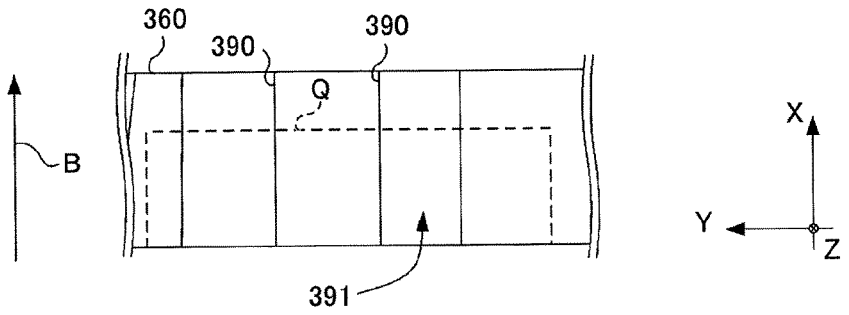
FIG. 18 illustrates a comparative example of grooves comparative to the first embodiment of the present invention.

For the purpose of explaining the above-mentioned configuration, a separation member 360 having a plurality of mutually parallel grooves 390 arranged parallel to the B direction that is the conveyance direction as illustrated in FIG. 18 will now be described as a comparison example.

In this example, when a sheet P moves along the B direction in a state of rubbing against the separation member 360, the toner on the sheet P may be deformed by projections 391 between the grooves 390, and streak-like unevenness of luster or the like may occur.

As a result of at least two of the grooves 39*a* overlapping along the B direction as in the present embodiment of the present invention, a sheet P is conveyed in a state where a surface of the sheet P passing on the grooves 39*a* is evenly in contact with the grooves 39*a* and the projections 39*b*. Therefore, generation of streaks along the conveyance direction is restrained.

Further, because there are the grooves 39*a*, the contact area between a sheet P and the separation member 36 is reduced. Therefore, adherence between the sheet P and the separation member 36 is reduced, and thus, conveyance of the sheet P is not obstructed.

Furthermore, the projections 39*b* are formed to have smoothly curved surfaces. Therefore, ideally, the projections 39*b* come into contact with a sheet P in a point contact manner, and thus, adherence between the sheet P and the separation member 36 is reduced, and conveyance of the sheet P is not obstructed.

In this regard, the minimum depth that defines the contact area between the wavy part 39 and a sheet P depends on the contact pressure between the sheet P and the separation member 36 after the type of a sheet P and the material of the separation member 36 are determined.

In a case where, as in the present embodiment of the present invention, the angle θ at which the separation member 36 is installed is inclined toward the pressing roller 27 side by an angle in a range of from 0 degrees through 10 degrees, in accordance with the conveyance direction B, the contact pressure is higher than the contact pressure of a case where the angle θ of the separation member 36 is directed toward the fixing roller 32 side. Therefore, it is desirable that the depth of the grooves 39*a* may be set greater.

Specifically, for a case where the angle θ at which the separation member 36 is installed is in a range of from 0 degrees through 10 degrees, it is desirable that the depth of the grooves 39*a* may be greater than or equal to 7.3 μm.

By thus setting the depth of the grooves 39*a* greater than or equal to 7.3 μm, the contact pressure between a sheet P and the separation member 36 is reduced and sheet jam is restrained.

In this regard, if the depth of the grooves 39*a* were to be increased unlimitedly, there are concerns that image luster unevenness at the depression pitches may be likely to occur upon an increase in the contact pressure.

In this regard, in a case where the angle θ of the separation member 36 was directed toward the fixing roller 32 side for reducing the contact pressure, luster unevenness was not detected even when the depth of the grooves 39*a* was greater than or equal to 50 μm.

However, in a case where, as in the present embodiment of the present invention, the angle θ was inclined toward the pressing roller 27 side by an angle in a range of from 0 degrees through 10 degrees, in accordance with the conveyance direction B, it was confirmed that luster unevenness was reduced as a result of the depth of the grooves 39*a* being set less than or equal to 38 μm.

Figure 12:
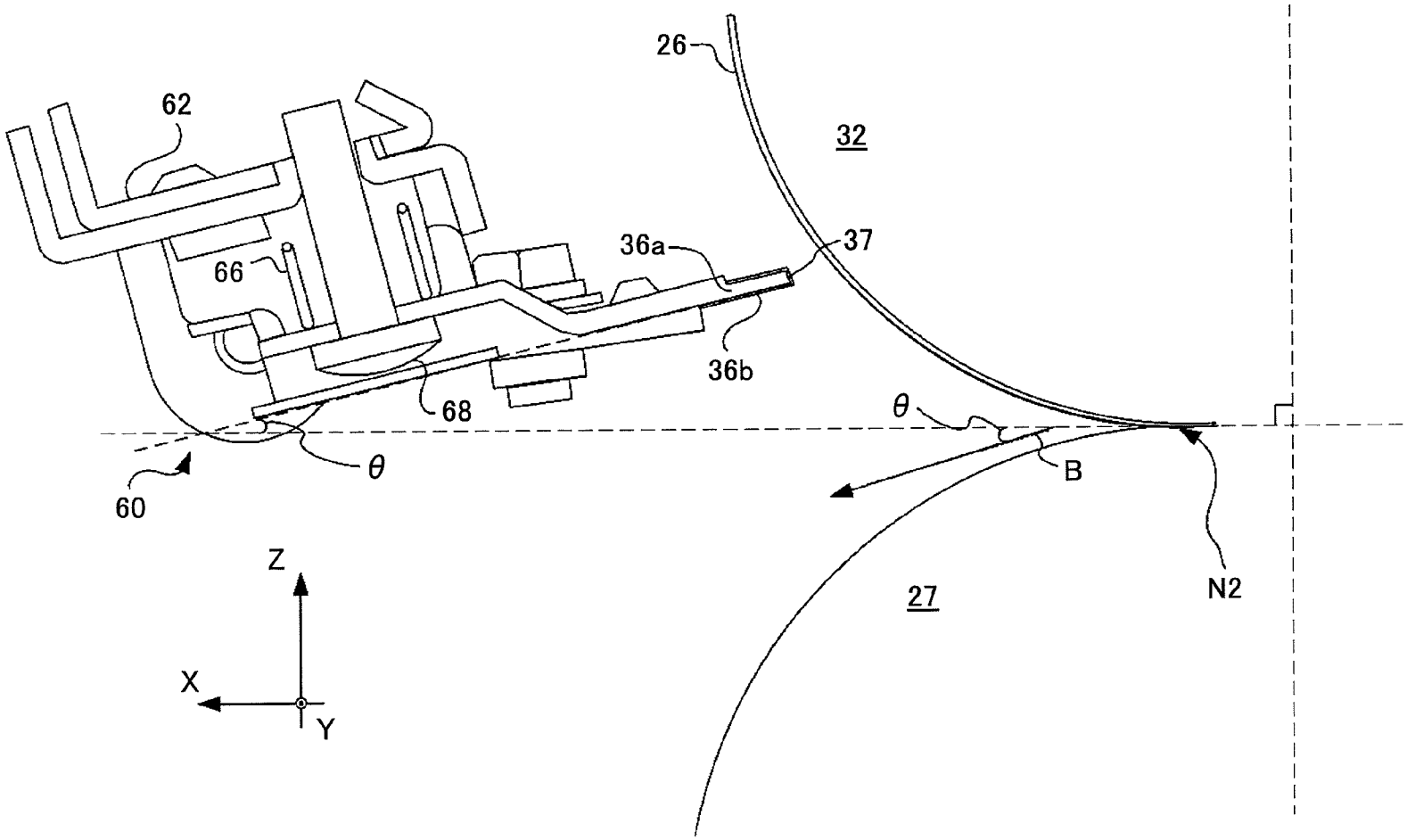
FIG. 12 illustrates one example of an overall configuration of a separation device according to a second embodiment of the present invention.

Thus, the installation angle θ of the separation member 36 may be such that the edge 37 is directed toward the fixing roller 32 side as illustrated in FIG. 12, or the separation member 36 may be inclined in such a manner that the edge 37 is directed toward the pressing roller 27 side. Note that the state where "the edge 37 is directed toward the fixing roller 32 side" clearly means that "the separation member 36 is inclined toward the pressing roller 27 side, in accordance with the conveyance direction B". In the same way, the state where "the edge 37 is directed toward the pressing roller 27 side" means that "the separation member 36 is inclined toward the fixing roller 32 side, in accordance with the conveyance direction B".

In a case where the edge 37 of the separation member 36 is inclined from an X-Y plane toward the pressing roller 27 side, there are concerns that the contact pressure between a sheet P and the edge 37 may increase depending on the conveyance state of the sheet P.

When the edge 37 comes into contact with a sheet P, the contact pressure is higher than a case where a flat area of the separation member 36 comes into contact with a sheet P. Therefore, the above-described luster unevenness may be likely to occur.

Therefore, it is desirable that a section of the wavy part 39 at the edge 37 may have the depth less than or equal to 3 μm for avoiding luster unevenness.

In this regard, the edge 37 has a high contact pressure and thus there are great concerns that a sheet P may adhere to the separation member 36 at the edge 37. Therefore, it is desirable that the length of the above-mentioned section where the depth is less than or equal to 3 μm may be limited to approximately 1 mm.

With the use of the wavy part 39 described above, occurrence of an image defect that may otherwise occur when a sheet P is stripped off from the fixing nip N2 is restrained.

Thus, according to the present embodiment of the present invention, the separation member 36 has the wavy part 39 at a position covering the sheet passing zone Q.

The wavy part 39 has the plurality of the mutually parallel grooves 39*a* that extend along the direction inclined from the B direction and inclined from the Y direction. The grooves 39*a* are formed in such a manner that at least two of the grooves 39*a* overlap along the B direction.

Thanks to the above-mentioned configuration, occurrence of an image defect that may otherwise occur when a recording medium is stripped off from a nip is restrained.

Further, according to the present embodiment of the present invention, the gap G1 between the edge 37 and the fixing belt 26 at the center of the separation member 36 with respect to the Y direction is smaller than the gap G2 between the edge 37 and the fixing belt 26 at an end of the separation member 36 with respect to the Y direction.

Thus, the gaps G1 and G2 between the separation member 36 and the fixing belt 26 are arranged in such a manner that the gap is wider at a Y direction end than the gap at a Y direction center. As a result, even when the fixing roller 32 expands thermally, the gap between the separation member 36 and the fixing belt 26 is controlled with high accuracy, and thus a sheet P can be easily stripped off.

Second Embodiment

As a second embodiment of the present invention, the separation device 60 as illustrated in FIG. 12 will be described.

Concerning the present embodiment of the present invention, the same reference signs are given to the elements in common with the first embodiment of the present invention, and their description will be appropriately omitted.

According to the present embodiment of the present invention, the separation member 36 includes a body 36*a* and a tape member 36*b*. The tape member 36*b* is formed on a surface of the separation member 36 including an edge 37 directed toward the fixing nip N2 side and is a surface layer member more slidable than the body 36*a*.

The body 36*a* is made of a heat-resistant plastic plate or a metallic plate such as a SUS. Further, in order to be able to reduce a gap between the body 36*a* and the fixing nip N2, it is desirable that the edge 37 that is an extending end in the −X direction may be like a thin sheet with a thickness of 0.4 mm.

The tape member 36*b* is adhered onto the body 36*a* to cover a −Z direction side surface of the body 36*a* and to turn back at the edge 37 that is the −X direction end to partially cover a +Z direction side surface of the body 36*a*.

The tape member 36*b* is made of a highly slidable and highly releasable material, for example, a fluororesin such as Teflon (registered trademark).

It is desirable that the tape member 36*b* may be formed in such a manner that the total thickness of the tape member 36*b* and the edge 37 is limited to approximately 0.6 mm, so as not to inhibit reduction in the gap between the tape member 36*b* and the fixing nip N2.

Figure 13:
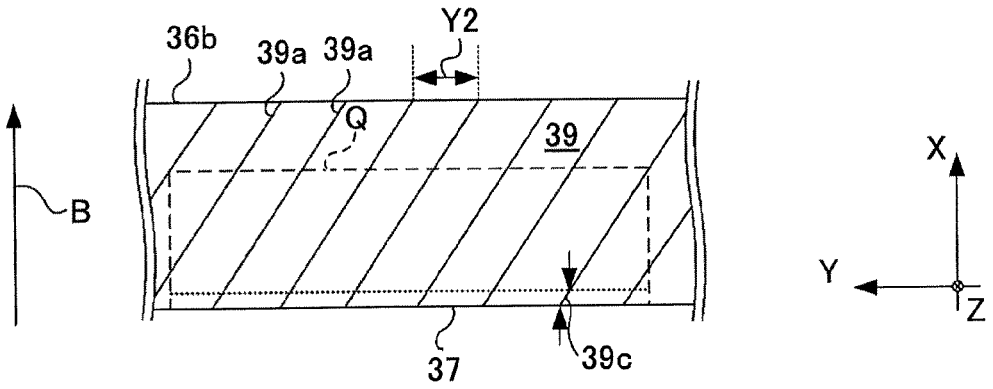
FIG. 13 illustrates one example of a configuration of a wavy part according to the second embodiment of the present invention.

The tape member 36*b* has the wavy part 39 that covers the sheet passing zone Q and has the plurality of mutually parallel grooves 39*a* at intervals Y2, as illustrated in FIG. 13.

Further, according to the present embodiment of the present invention, the grooves 39*a* have shallow groove sections 39*c* within a predetermined length of the body 36*a* at the edge 37 side, i.e., in this example, within 1 mm of the body 36*a* at an extending end. In the shallow groove sections 39*c*, the grooves 39*a* are shallower than at the other sections.

That is, the wavy part 39 has depressed areas that are shallower at the extending end in the −X direction and deeper at the other section.

Thanks to the wavy part 39 having the above-mentioned configuration, the contact resistance between a sheet P and the separation member 36 is reduced when the sheet P is ejected from the fixing nip N2, and occurrence of an image defect is restrained.

According to the present embodiment of the present invention, the wavy part 39 is formed to cover the sheet passing zone Q. However, it is also possible that the wavy part 39 is formed to cover the entire surface of the tape member 36*b*.

A contact state between a sheet P and the separation member 36 varies greatly depending on the type of the sheet P, an image formed on the sheet P, and so forth.

Therefore, in order to reduce the contact resistance between a sheet P and the separation member 36 in any conditions, it is most desirable that the wavy part 39 may be formed to cover the sheet passing zone Q.

According to the present embodiment of the present invention, in the wavy part 39 of the tape member 36*b*, the grooves 39*a* have the interval Y2 of 1.2 mm. It is desirable that the interval Y2 may fall within an approximate range of from 0.8 mm through 1.2 mm. However, the grooves 39*a* may have another pitch such as 0.5 mm.

Figure 14A:
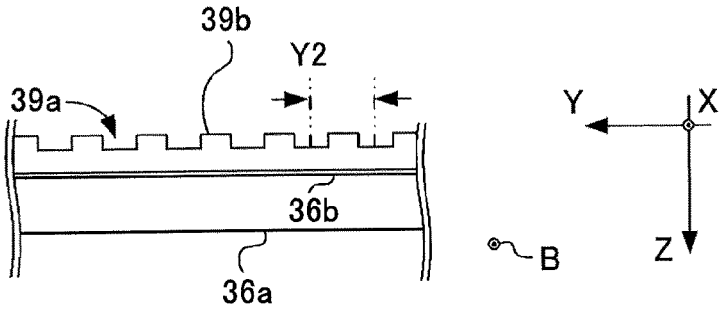
FIG. 14A is a sectional view illustrating one example of a sectional configuration of the wavy part according to the second embodiment of the present invention.
Figure 14B:
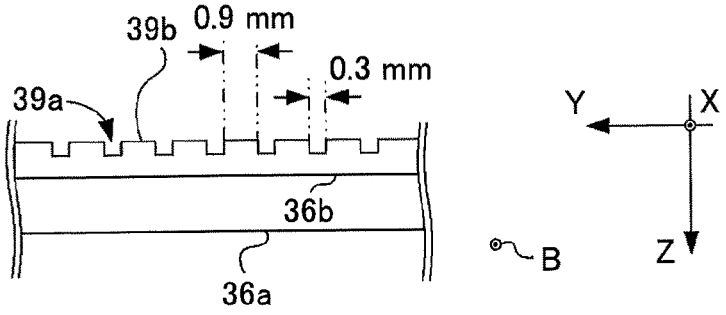
FIG. 14B is a sectional view illustrating one example of a sectional configuration of the wavy part according to the second embodiment of the present invention.

The duty ratio between the depressions and the projections of the wavy part 39 in a sectional view, i.e., the duty ratio between the grooves 39*a* and the projections 39*b* is, as illustrated in FIG. 14A, 0.6 mm for the depressions and 0.6 mm for the projections at an equal measure. However, it is also possible that, as illustrated in FIG. 14B, the duty ratio between the grooves 39*a* and the projections 39*b* is 0.3 mm for the depressions and 0.9 mm for the projections.

Further, it is desirable that the grooves 39*a* may have the depth greater than or equal to 7.3 μm as the depth in the first embodiment of the present invention except for the extending end 1 mm of the edge 37.

Note that the intervals and the dimensions illustrated above are examples, and may be changed appropriately according to various design matters.

A method for forming the wavy part 39 on the tape member 36*b* will now be described.

Figure 15:
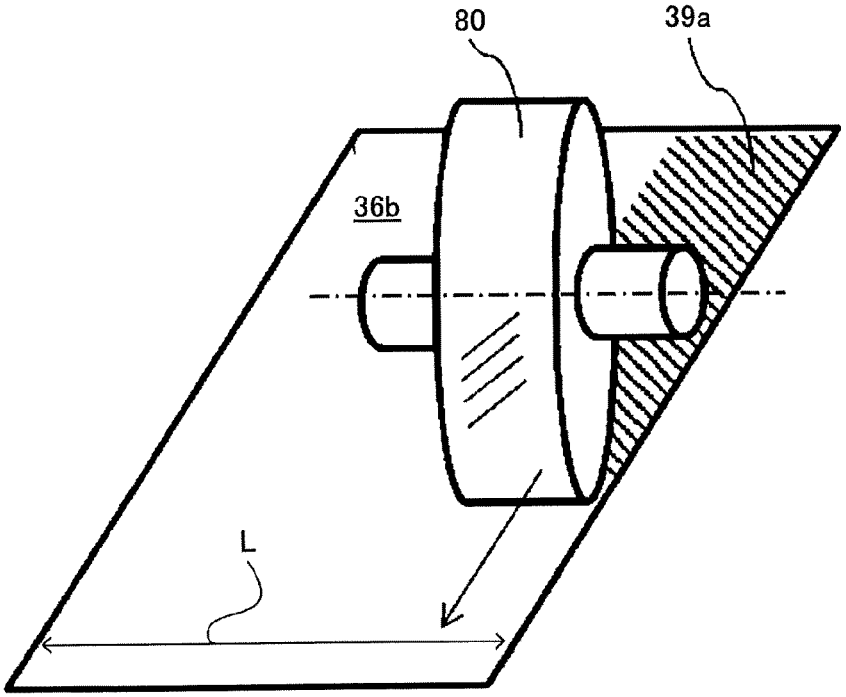
FIG. 15 illustrates one example of a method for forming grooves according to the second embodiment of the present invention.

As illustrated in FIG. 15, before the tape member 36*b* is adhered onto the separation member 36, one surface of the tape member 36*b* is pressed by a special tool 80. Thus, depressions/projections formed on the special tool 80 are transferred to the tape member 36*b*.

By thus forming the wavy part 39 according to the surface pressing process, the tape member 36*b* is prevented from including irregular projections upon being adhered onto the separation member 36, and the wavy part 39 is formed in the easiest manner.

The special tool 80 is, in more detail, a metallic tool where oblique projections such as a helical gear are regularly formed on the outer circumferential surface of a cylinder. For example, a commercially available knurl piece for forming a knurl shape or the like is used.

The width of the special tool 80 should not necessarily be the same as the width L of the wavy part 39.

In a case where the width of the special tool 80 is shorter than the width L of the wavy part 39, the surface pressing process may be performed several times to form the grooves 39*a* that are the depressions for the desired width L.

In a case where the width of the special tool 80 is equal to or greater than the width L of the wavy part 39, the wavy part 39 is formed by a one-step process. Thus, it is possible to form the wavy part 39 more efficiently.

Further, it is also possible to previously form the grooves 39*a* for a width greater than the desired width of the tape member 36*b*, and thereafter, to acquire the desired width of the tape member 36*b* by a cutting off process.

By forming the wavy part 39 over the entire surface of the tape member 36*b*, the tape member 37*b* can be adhered onto the separation member 36 without concern for the positional accuracy of the start position and the end position of the grooves 39*a*, and thus, the manufacturing process is simplified.

According to the present embodiment of the present invention, the separation member 36 has the plate-like body 36*a* that extends along the Y direction; and the tape member 36*b* that is the surface layer member more slidable than the body 36*a* and that is formed on the surface of the edge 37 of the body 36*a*, the edge 37 being a portion directed toward the fixing nip N2 side.

In the tape member 36*b*, the wavy part 39 is formed.

Thanks to the above-mentioned configuration, occurrence of an image defect that may otherwise occur when a sheet P is stripped off from the fixing nip N2 is restrained.

Further, according to the present embodiment of the present invention, the surface layer member is the tape member using a fluororesin.

Thanks to the above-mentioned configuration, the manufacturing is simplified, and also, the releasability improves so that conveyance of a sheet P is not obstructed and occurrence of an image defect is restrained.

Figure 16:
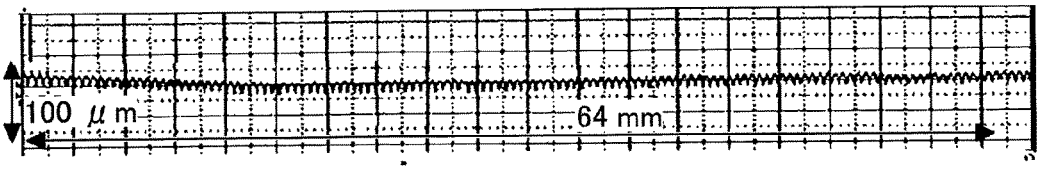
FIG. 16 illustrates one example of a surface state of grooves according to the second embodiment of the present invention.

FIG. 16 illustrates a profile of a surface state of the tape member 36*b* formed by the knurling process. In comparison to FIG. 17A, an irregular projection did not occur, and it was able to be confirmed that, even when a solid image was printed on a sheet P, generation of luster streaks was restrained.

It is also possible to set the depth of the grooves 39*a* depending on the distance from the edge 37 as follows: The depth Z1 of the depressions/projections is set to fall within a range of from 20 μm through 45 μm for a range of from 2 mm through 2.5 mm from the edge 37; and to fall within a range of from 3 μm through 45 μm for a range of from 2.5 mm through 12 mm from the edge 37.

In particular, for a position of 2 mm through 2.5 mm at the extending end of the edge 37, the contact pressure between a sheet P and the separation member 36 is greater in comparison to the other section so that the sheet P is likely to adhere to the separation member 36. Therefore, it is desirable that the lower limit of the depth of the grooves 39*a* may be set as 20 μm and may be greater than the lower limit of the other section.

By thus setting the plurality of the grooves 39*a* to have the depth varying depending on the distance from the edge 37, the contact resistance between a sheet P and the separation member 36 is reduced when the sheet P is ejected from the fixing nip N2 and is separated by the separation member 36, and the conveyance quality is improved.

In this regard, it is desirable that the upper limit of the depth Z1 of the grooves 39*a* that is the depression/projection amount according to the present embodiment of the present invention may be approximately 45 μm. This is because, if the depth Z1 is greater than or equal to 45 μm, breakage such as being cut may occur in the tape member 36*b* during the depression/projection forming process, and thus a luster streak may be generated at the position corresponding to a depression/projection.

Further, if the pitch between adjacent grooves 39*a* is greater, there is a tendency that a luster streak is likely to be generated. However, as a result of the gaps G1 and G2 between the separation member 36 and the exit of the fixing nip N2 being made greater, the contact pressure between a sheet P and the separation member 36 can be reduced. Therefore, the pitch of the grooves 39*a* formed in the separation member 36 may be determined appropriately depending on the gap between a sheet P and the separation member 36. Thanks to the above-mentioned configuration, it is possible to reduce the contact pressure to reduce luster streaks.

For a case where a sheet P ejected from the fixing nip N2 is conveyed in a state where the sheet P is in contact with the separation member 36, the plurality of grooves 39*a* are formed along the direction inclined from the conveyance direction at least for an area including the sheet passing zone Q. Thanks to the above-mentioned configuration, the contact pressure between a sheet P and the separation member 36 is reduced upon the sheet P being separated, and the friction resistance during the conveyance is reduced. Therefore, it is possible to restrain occurrence of jamming of a sheet P and to restrain generation of luster streaks in the image.

Further, because the grooves 39*a* are inclined from the B direction, it is possible to avoid generation of a mark in the image on a sheet P corresponding to the depression/projection.

Thus, the separation members, the separation devices, the fixing devices, and the image forming apparatuses have been described in the embodiments. However, the present invention is not limited to these embodiments, and various modifications and alterations can be made within the scope of the present invention described in the claims.

For example, in the above-mentioned embodiments, the case of the nip at the fixing device has been described. However, it is also possible to use the present invention for stripping off a recording medium that is conveyed through a nip such as a nip at the secondary transfer position.

Further, in the above-mentioned embodiments, the image forming apparatus forming an image on a recording medium has been described. However, it is also possible to implement the present invention in another configuration such as a conveyance apparatus that coveys a sheet-like conveyance object.

Third Embodiment

Hereinafter, a third embodiment of the present invention will be described with reference to drawings.

Before describing the present embodiment of the present invention, a conventional configuration and a problem of the conventional configuration will be described in detail.

A toner mainly including a resin has a nature of being melted at a pressing device and adhering to a fixing roller or a fixing belt. Adherence of a toner to a fixing roller or a fixing belt is avoided by various methods such as adding a wax component in a toner; coating a surface of a fixing roller or a fixing belt with a material having releasability; and coating a surface of a fixing roller or a fixing belt with a release agent such as a silicone oil.

A separation claw or a separation plate is disposed in contact with or near a pressing device. Therefore, a toner immediately after passing through the pressing device and thus not having been cooled, that is, a toner still in a melted state, comes into contact with the conveyance surface of the separation claw or the separation plate.

At this time, for a case where the surface texture of the conveyance surface of the separation claw or the separation plate is rough, the melted toner may be scratched and a streak image may be output.

For a case where the conveyance surface of the separation claw or the separation plate is smooth, adherence of the conveyance surface to the melted toner is high, resulting in generation of conveyance resistance that degrades the conveyance quality of a recording medium.

Even when the separation claw or the separation plate having the conveyance surface of an appropriate surface texture to satisfy conditions for avoiding streak images and avoiding degradation in conveyance quality is used initially, repetitious sheet passing operations may polish and smooth the surface texture of the separation claw or the separation plate with time.

If the surface texture of the separation claw or the separation plate is thus smoothed, adherence to a melted toner increases, and the recording medium conveyance quality degrades.

Further, even in a case of, for example, using such a separating configuration in which a separation member such as a separation claw or a separation plate is disposed at a small gap from a fixing roller or a fixing belt, the separation member is to be away from a downstream end of a fixing nip in consideration of the thickness and the gap amount of the separation member.

At the position away from the downstream end of the fixing nip, the recording medium is lifted in a state of being wound on the fixing roller or the fixing belt. Thus, the component force perpendicular to the recording medium conveyance direction is greater.

As a result, the contact force of the toner on the recording medium to the separation member is greater, resulting in a disadvantageous situation concerning a streak image.

Such a problem is remarkable for a recording medium called coat paper coated with a resin layer on its surface and recently having become much in demand. Coat paper is such a recording medium, where common paper fibers are coated with a resin layer, the stiffness (toughness) of the coat paper being reduced as a result of being heated by a fixing device. As a result, the stiffness of the recording medium against adherence between the fixing roller or the fixing belt and the toner is weaker, and the contact force of the toner to the separation claw or the separation plate is stronger.

Thus, the above-mentioned problem is remarkable.

Figure 19:
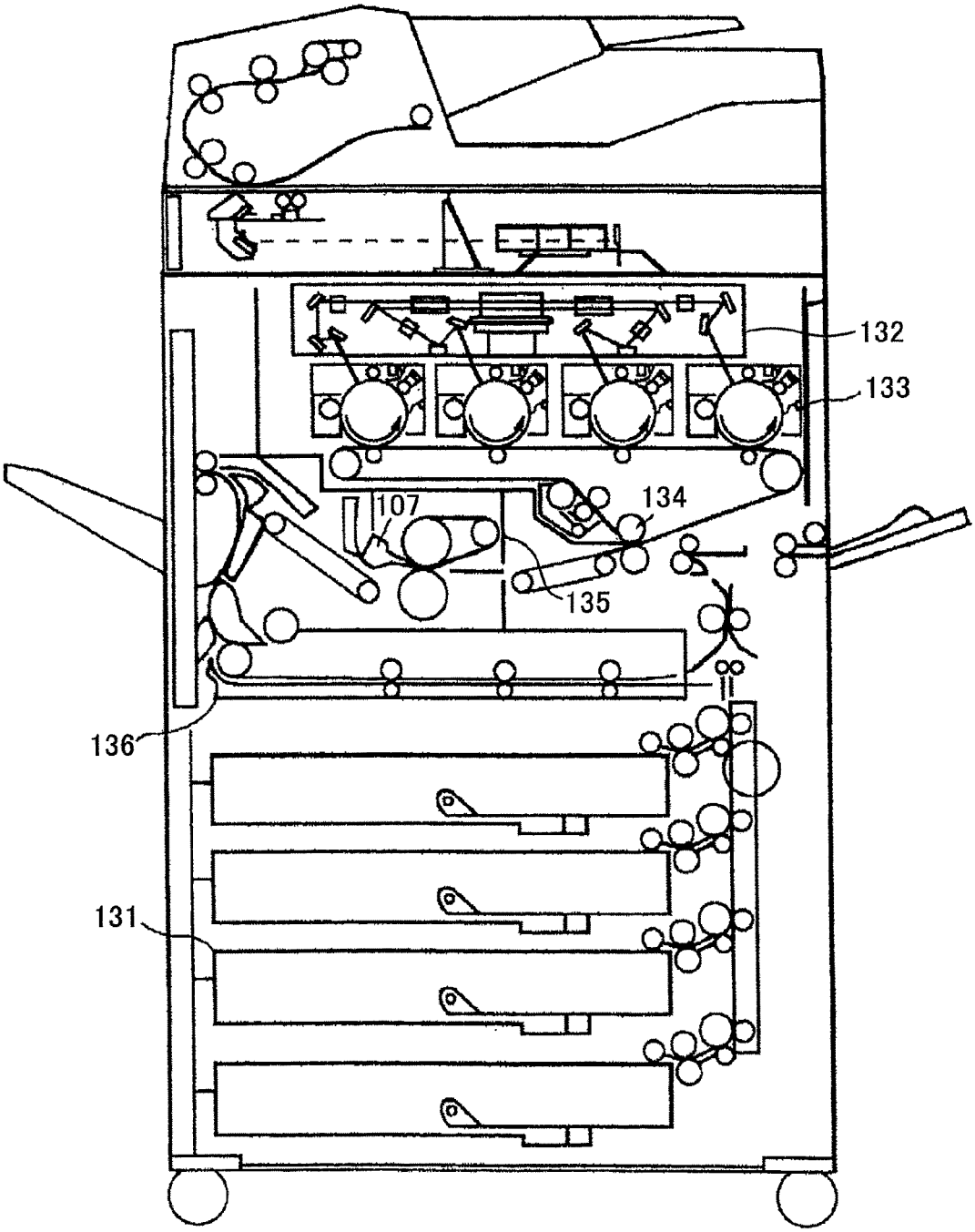
FIG. 19 illustrates a general configuration of an image forming apparatus according to a third embodiment of the present invention.

FIG. 19 generally illustrates an image forming apparatus that includes a fixing device according to the present embodiment of the present invention. The overall mechanism of the image forming apparatus is basically the same as the overall mechanism of a known configuration. That is, around photoconductor drums that are image carrying members, predetermined devices for forming images such as charging devices, exposing devices (writing units), developing devices, and so forth are installed.

Briefly explaining, a sheet feeding unit 131 conveys a sheet as a recording medium to a transfer unit. The writing units 132 expose the photoconductor drums in an image formation unit 133 on the basis of a signal from a scanner that reads an original document or on the basis of a signal from an external PC (personal computer) to form latent images on the photoconductor drums.

The latent images thus formed on the photoconductor drums are made visible by toners in the image formation unit 133, and then are transferred to an intermediate transfer belt first. The toner image thus transferred to the intermediate transfer belt is then transferred, by the transfer unit 134, to the sheet that has been conveyed.

The toner image that has been thus transferred to the sheet but has not been fixed yet is then fixed by a fixing device 135. The sheet is then stripped off from a fixing belt of the fixing device 135 by a separation device 107, and then is ejected to the outside of the image forming apparatus. In a case of a both-side image forming process, a both-side unit 136 inverts the sheet, which is then conveyed to the transfer unit again, and is then ejected after being processed by the fixing device 135 and the separation device 107.

Figure 20:
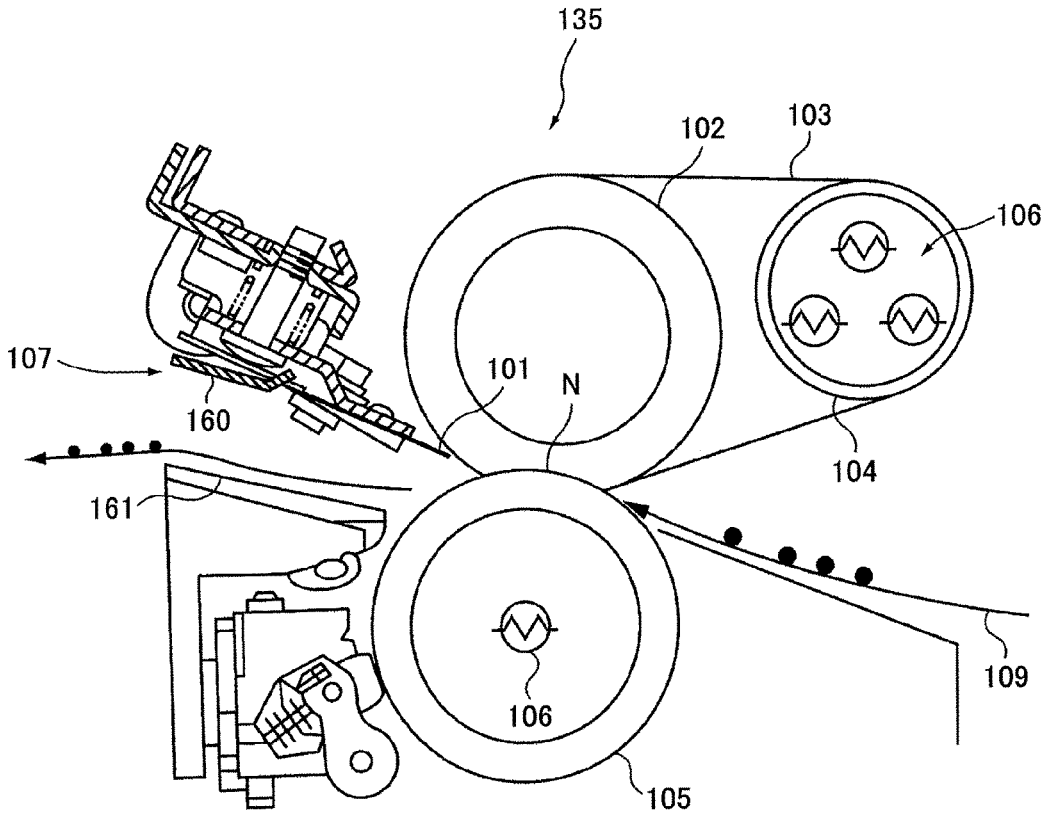
FIG. 20 is a general sectional view of a fixing device and a separation device.

FIG. 20 illustrates the fixing device 135 and the separation device 107, and illustrates a fixing roller and a pressing roller in a sectional view taken along a direction perpendicular to their rotation axes.

On the inside of the fixing belt 103 of the fixing device 135, the fixing roller 102 and a heating roller 104 are installed. The pressing roller 105 that is a rotation member is pressed onto the fixing roller 102 to form a fixing nip N with the fixing belt 103 in between, the fixing belt 103 being another rotation member.

Inside the heating roller 104 and the pressing roller 105, halogen heaters 106 that are heat sources are installed. A sheet 109 carrying a toner image that has not been fixed yet and having been conveyed from the right side in FIG. 20 is nipped and heated by the fixing nip N that thus performs fixing.

The fixing belt 103 is such that, on a substrate surface layer made of a polyimide resin and having an inner diameter of 75 mm and a thickness of 90 μm, a silicone rubber of a thickness of 200 μm is formed, and, as an outermost layer, a PFA (tetrafluoroethylene perfluoroalkylvinylether copolymer) coating having a thickness of 20 μm is formed, for example.

The fixing belt 103 is wound between the fixing roller 102 that has an expanded silicone rubber layer with a thickness of 14 mm and has an outer diameter of 52 mm; and the heating roller 104 that is an aluminum hollow cylinder with an outer diameter of 35 mm and a thickness of 0.6 mm.

The pressing roller 105 has an outer diameter of 50 mm and is such that the circumferential surface of a hollow core metal made of steel and having a thickness of 1 mm is coated with a silicone rubber having a thickness of 1.5 mm, and a PFA tube may be provided as an outermost layer.

The pressing roller 105 advances into the fixing roller 102 by 3 mm with the fixing belt 103 in between and forms the nip of a width of approximately 14 mm along the sheet conveyance direction.

On the downstream side of the fixing nip with respect to the recording medium conveyance direction and on the fixing belt 103 side, the separation device 107 is installed for separating (stripping off) a sheet 109 from the fixing belt 103. The separation device 107 has a flat-plate-like separation member 101, the extending end of which projects toward the fixing nip side. The separation member 101 is formed like a flat plate extending continuously for the maximum width of a sheet that is a separation object along the width direction of the sheet (the axial direction of the rotation members) in parallel. In other words, the separation member 101 has a dimension along a rotational axis direction of the fixing belt 103 greater than or equal to the maximum image area.

Assuming the shape of the separation member 101 as a claw, the separation member may be called a separation claw.

A sheet 109 separated from the fixing belt 103 by the separation member 101 is then guided by a fixing-side guide plate 160 and a pressing-side guide plate 161 (see FIG. 20) and is conveyed toward the sheet ejection unit.

Figure 21:
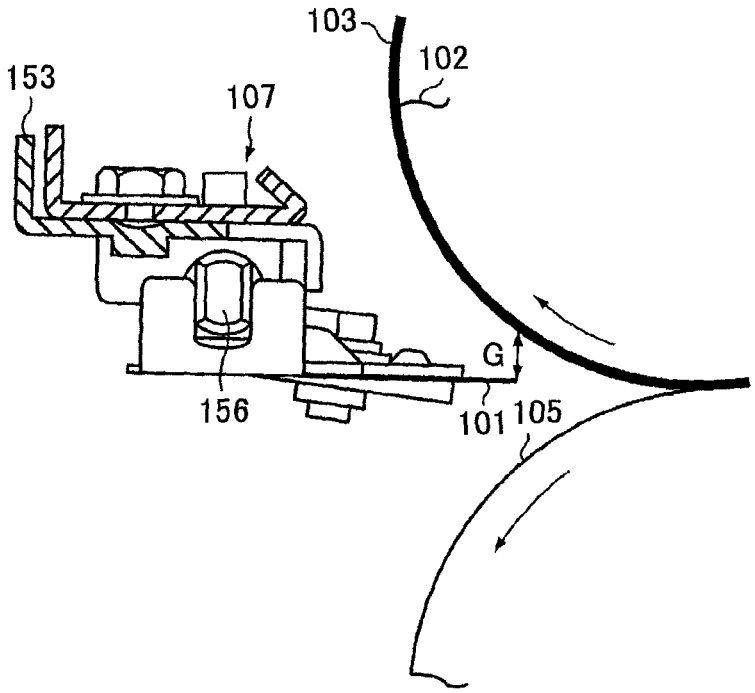
FIG. 21 illustrates a manner of positioning a separation member with respect to a fixing belt.

The separation member 101 is, as illustrated in FIG. 21, installed at a stay 153 by a sliding pin 156. Thus, the separation member 101 is movable vertically in FIG. 21 but is not movable along the sheet conveyance direction (the sheet passing direction).

The separation member 101 thus supported by the above-mentioned position adjusting mechanism is positioned by the sliding pin 156 and is installed at the stay 153. The position of the separation member 101 with respect to the stay 153 is adjustable vertically in the direction perpendicular to the sheet conveyance direction.

Figure 22:
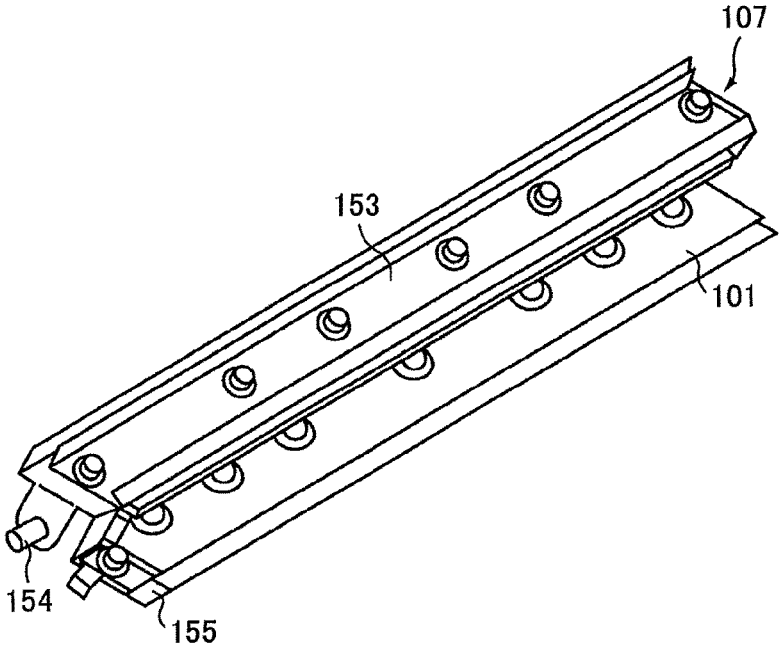
FIG. 22 is a perspective view of the separation member.

As illustrated in FIG. 22, abutting plates 155 are installed at both ends in the longitudinal directions of the stay 153 other than at the sheet passing zone. As a result of the extending ends of the abutting plates 155 coming into contact with and sliding on the fixing belt 103, the separation member 101 is positioned with respect to the fixing belt 103.

The separation device 107 is supported on side plates of the fixing device 135 with the use of shaft pins 154 that are installed at both ends in the longitudinal directions.

Figure 23:
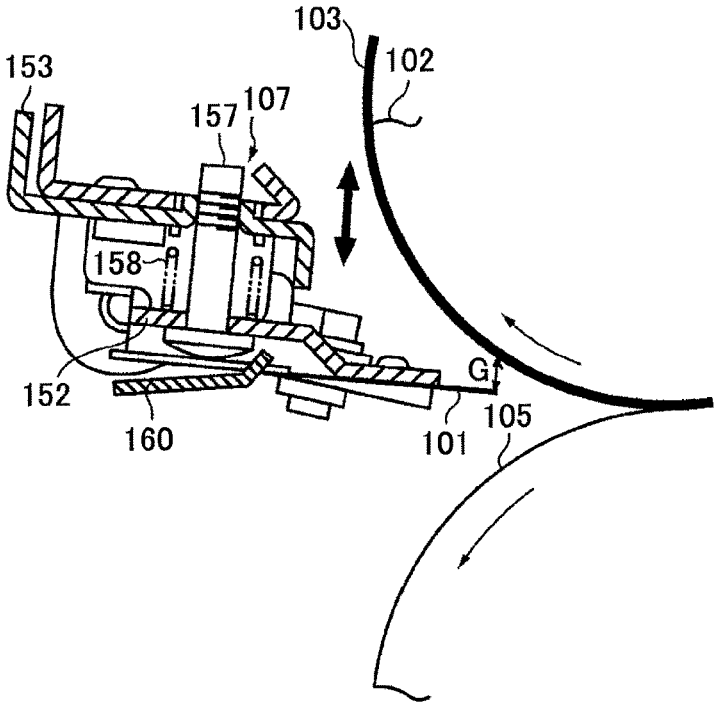
FIG. 23 illustrates a configuration for adjusting a position of the separation member with respect to the fixing belt.

As a result, as illustrated in FIG. 23, it is possible to manage the gap G between the extending end of the separation member 101 and the fixing belt 103 with high accuracy.

The separation member 101 is supported at a movable stay 152, and it is possible to finely adjust the gap G from the fixing belt 103 by turning an adjusting screw 157 under a state of pressing force of a coil spring 158 disposed between the stay 153 and the movable stay 152.

The thickness of the extending end of the separation member 101 at the fixing nip side is reduced to 0.2±0.1 mm. Thus, the extending end of the separation member 101 is capable of approaching the downstream end of the fixing nip N with respect to the sheet conveyance direction.

As a result, it is possible to rapidly separate a sheet 109 sent out from the exit of the fixing nip N (the downstream end with respect to the sheet conveyance direction) from the fixing belt 103 so that it is possible to avoid giving extra heat to the image.

Figure 24:
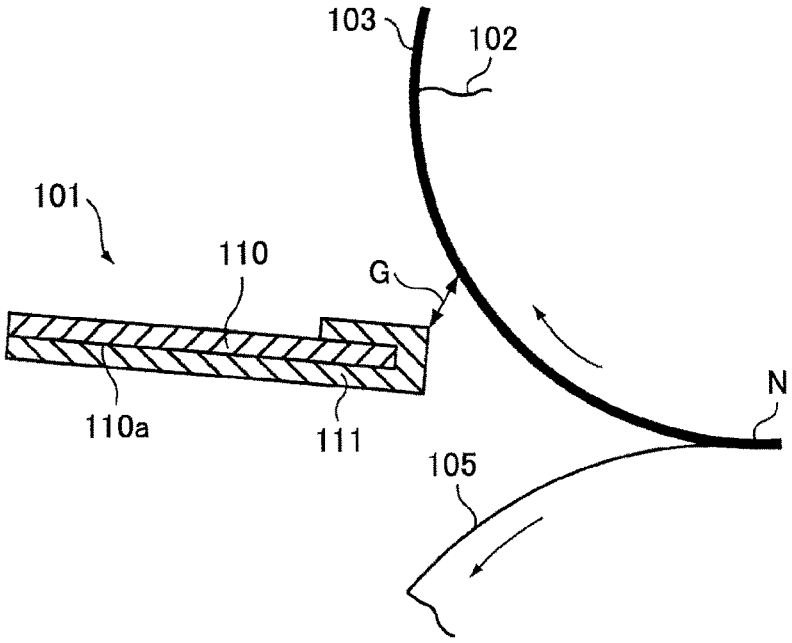
FIG. 24 is an enlarged sectional view illustrating a configuration of the separation member.

As illustrated in FIG. 24, the separation member 101 includes a separation member body 110 made of a rigid metallic plate; and a tape-like member 111 that is a surface layer installed on a sliding surface 110*a* of the separation member body 110 where a sheet 109 comes into contact. The sliding surface 110*a* is a sheet passing guidance surface on which the image formed side of a sheet 109 separated from the fixing belt 103 slides.

The tape-like member 111 is installed to not only cover the sliding surface 110*a* of the separation member body 110 but also partially cover the reverse side after covering the extending end of the separation member body 110.

The tape-like member 111 is made of a releasable material, for example, a fluororesin (in this example, Teflon (registered trademark)) to reduce the contact resistance between the tape-like member 111 and a sheet 109, and is adhered and fixed to the separation member body 110.

The thickness of the extending end of the separation member 101 including the thicknesses from the tape-like member 111 is set to be less than or equal to 0.5 mm. As a result, the extending end of the separation member 101 is capable of approaching the exit of the fixing nip N even with the tape-like member 111 that is adhered onto the separation member 101. Therefore, it is possible to improve the releasability of a sheet 109 from the separation member 101, and to rapidly strip off the sheet 109 sent out from the fixing nip N from the fixing belt 103. As a result, it is possible to accelerate cooling of the melted toner on the sheet, and to prevent extra heat from being given to the image.

The tape-like member 111 has such a shape as to reduce the area where a sheet actually comes into contact with the sliding surface 110*a*. Specifically, a surface of the tape-like member 111 has a plurality of projections, a sheet comes into contact with the projections, and thus the sliding surface area is reduced.

Figure 25:
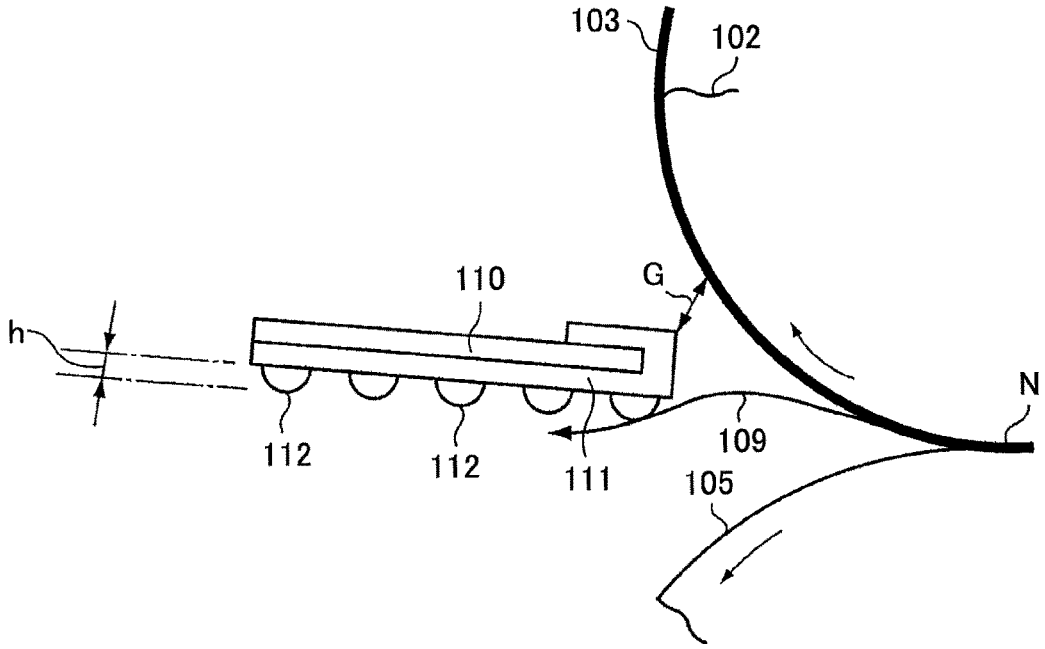
FIG. 25 is an enlarged side view illustrating shapes of projections on a sliding surface of the separation member.

FIG. 25 is a schematic diagram illustrating the projections 112 on the surface of the tape-like member 111. It is desirable that the height h of the projection 112 may be greater than or equal to 10 μm.

The projection ends of the projections 112 on the bottom side come into contact with a sheet 109, and thus it is possible to reduce the sliding surface area. In this regard, because a sheet is not a rigid body, the sliding surface area for a sheet depends on the shapes of the projection ends, the heights, and the intervals of the projections 112.

For example, in a case where the intervals of the projections 112 along the sheet conveyance direction are greater and the heights of the projections 112 are smaller, a sheet may come into contact with also the depressions between the projections 112 of the tape-like member 111, and thus it may be impossible to obtain the effects of reducing the sliding surface area.

Desirable intervals of the projections 112 depend on the shapes of the projections and are approximately less than or equal to 3 mm.

Figure 26:
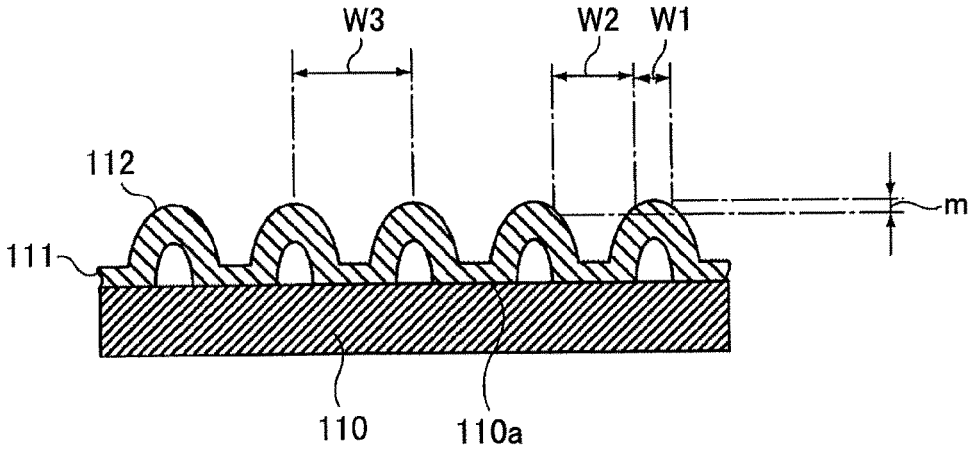
FIG. 26 is an enlarged sectional view illustrating shapes of projections on the sliding surface of the separation member.

Even though the projections 112 are rounded, the contact occurs not only with points because the tape-like member 111 and a sheet 109 are not rigid bodies. As illustrated in FIG. 26, an extent m less than or equal to a height 10 μm from a contact point is regarded as a contact extent. In FIG. 26, the sign W1 denotes an extent of a projection surface, W2 denotes an extent of a depression surface, and W3 denotes an interval (a pitch) of the projections 112.

In a case where the conditions for a sheet to come into contact with the projections 112 without coming into contact with the depressions are satisfied as mentioned above, the effects from reducing the actual sliding surface area of a sheet on the sliding surface 110*a* were confirmed; specifically, for the effects for sheet conveyance to be apparent, the actual contact area of a sheet is reduced to less than or equal to 70% of the entire area of the sliding surface 110*a*. However, it is noted that even in a case where the contact area is 70% or more, the effects are not unavailable.

Figure 27:
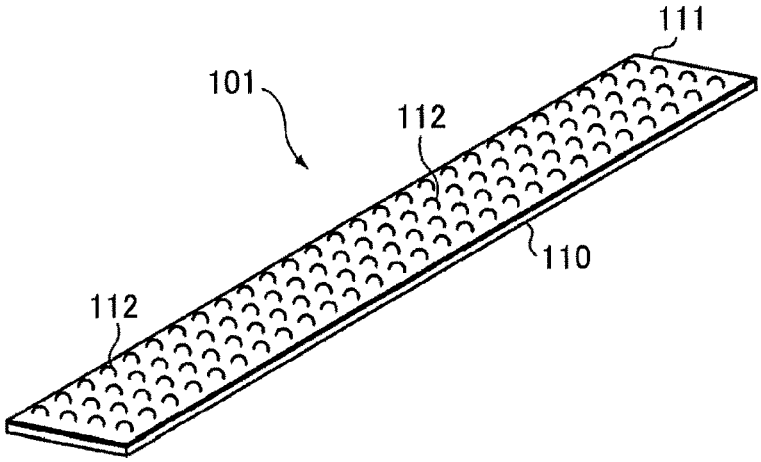
FIG. 27 is a perspective view illustrating a manner of arranging the projections on the sliding surface of the separation member.

FIG. 27 is a schematic perspective view illustrating an arrangement of the projections 112 formed on a surface of the tape-like member 111. The projections 112 are conical with rounded projection ends. In more detail, as described above, the heights of the projections 112 are greater than or equal to 10 μm; the intervals are less than or equal to 3 mm; and the sliding surface area within the height 10 μm from the apexes of the cones is less than or equal to 70% with respect to the area before the projections are formed.

Thanks to the above-mentioned distribution of the projections 112, it is possible to reduce the area where the toner image on a sheet comes into contact with the separation member 101. Further, because the shape of the projections 112 does not include ridges parallel to the sheet conveyance direction, it is possible to restrain generation of a streak image that may be otherwise generated as a result of the toner surface being scratched.

The bottoms of the cones of the projections 112 are not limited to being rounded, and may have elliptic shapes or other shapes.

It is more desirable that the projections 112 may be arranged in a staggered manner, for example, so that the contact areas between the toner image surface on a sheet and the separation member 101 along the main-scanning directions are uniform.

Figure 28:
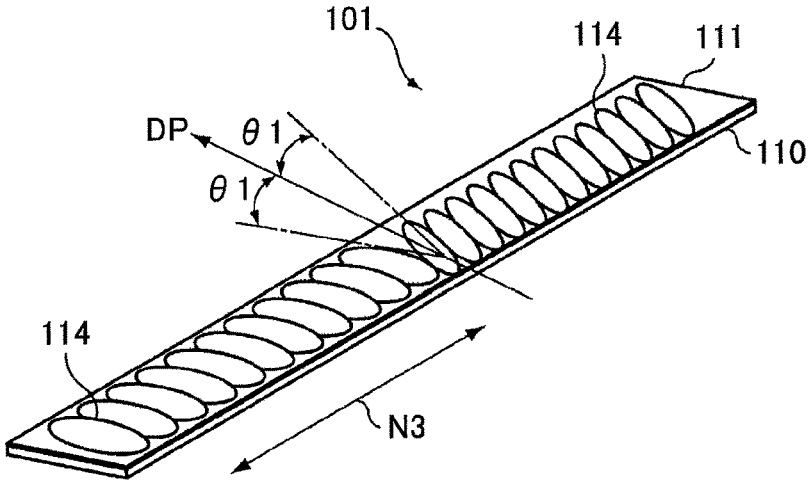
FIG. 28 is a perspective view illustrating a variant of the projections on the sliding surface of the separation member.

FIG. 28 illustrates a variant of the projections. The projections 113 in this example project elliptically, and the longitudinal axes of the projections 113 have angles θ1 to the sheet conveyance direction DP. In addition, the projections 113 are distributed line-symmetrically with respect to the center of the separation member 101 along the main-scanning directions N3 (the longitudinal directions of the separation member 101).

In other words, the projections 113 have the inclination angles θ1 from the sheet conveyance direction toward the width directions of a sheet perpendicular to the conveyance direction, and symmetrically widen with respect to the center of the width directions in accordance with the downstream direction with respect to the conveyance direction.

By forming the projections in this way, it is possible to reduce the area where the toner image on a sheet comes into contact with the separation member. Further, because there are no ridges parallel to the sheet conveyance direction, it is possible to restrain generation of a streak image that may be otherwise generated as a result of the toner surface being scratched.

Next, a method for forming the projections 112 in the tape-like member 111 will be described.

For forming the projections 112, a press-to-work process is used to press a pressing member that has desired projections to be formed in the tape-like member 111 onto the tape-like member 111 to deform the tape-like member 111.

The press-to-work process may be performed on the tape-like member 111 either before or after the tape-like member 111 is adhered onto the separation member body 110. The case where the press-to-work process is performed after the adhering process will now be described first.

As described above, the tape-like member 111 is made of a soft fluororesin whereas the separation member body 110 is a rigid body. Therefore, in the case where the press-to-work process is performed after the adhering process, the fluororesin is plastically deformed to form the depressions/projections. In this case, the deformation of the tape-like member 111 includes deformation to considerably change the tape thickness.

Figure 29A:
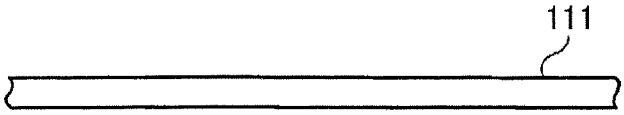
FIG. 29A illustrates a method for forming the projections on the sliding surface of the separation member.
Figure 29B:
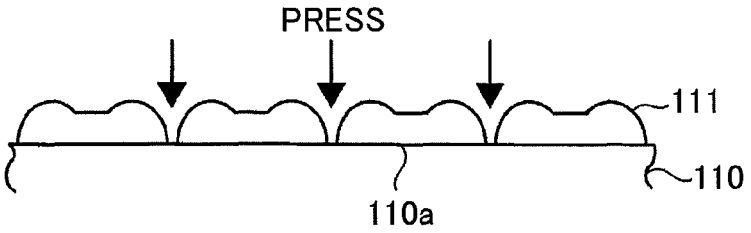
FIG. 29B illustrates the method for forming the projections on the sliding surface of the separation member.

In a state where the back side is supported by the separation member body 110 that is the rigid body, it is difficult to plastically deform the thin tape-like member 111 (see FIG. 29A) to form depressions/projections with an increased height and it is difficult to ensure a desired depression/projection height and a desired pitch simultaneously. Thus, the flexibility in working the tape-like member 111 is reduced as illustrated in FIG. 29B.

Figure 30:
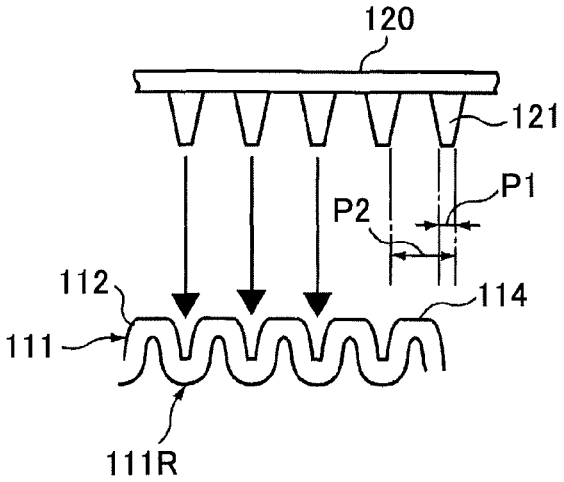
FIG. 30 illustrates another method for forming the projections on the sliding surface of the separation member.

Next, a case where the press-to-work process is performed before adhering the tape-like member 111 onto the separation member 110 will now be described. For forming depressions/projections by the press-to-work process, as illustrated in FIG. 30, a receiving member opposite to the pressing member 120 is to be used. In a case where the receiving member is a rigid body, the flexibility in working the tape-like member 111 is reduced as in the above-described case where the press-to-work process is performed after the adhering process.

In the present embodiment of the present invention, the receiving member at opposite that is used is deformable and expected to deform in response to being pressed by the pressing member. For example, a rubber, an expanded member like a sponge, or the like, can be used.

Also in this case, the tape-like member 111 plastically deforms. However, in this case, the tape thickness does not appreciably change. Therefore, it is possible to form depressions/projections greater than the case where pressing is performed against a rigid body.

The turning and pressing of the pressing member 120 that is a die and a circular member having projections circumferentially onto an object is as per common practice. For the sake of simplifying the explanation, the description will now be made with the use of the schematic diagram where the projections are provided on the flat plate.

In a case where the pressing member 120 is used to press to form the appropriate depressions/projections, the ratio of the pressing width (the ratio of the width P1 of the projection 121) is approximately 30%. If the ratio were greater, the entirety of the tape-like member 111 would be pressed and deformed, and thus, it would not be possible to obtain appropriate depressions/projections.

In the case where the pressing ratio is approximately 30%, the thus worked tape-like member 111 has the image sliding surface area of approximately 70%, and this value is the limit for obtaining the effects from reducing the sliding surface area. This is because, after the pressing, the flat areas 114 remain on the projections 112.

In FIG. 30, the reference sign P2 denotes the pitch of the projections 121.

On the reverse side 111R of the tape-like member 111 that has been deformed as a result of being pressed by the pressing member 120, the area ratio is smaller because the projections 121 of the pressing member 120 are pressed into the tape-like member 111 at the ratio of 30%. In addition, on the reverse side 111R, the flat areas are smaller because the tape-like member 111 has been plastically deformed as a result of being pressed by the pressing member 120.

By using the reverse side 111R as the sheet sliding surface, it is possible to obtain the tape surface having the reduced sliding surface area ratio.

Figure 31:
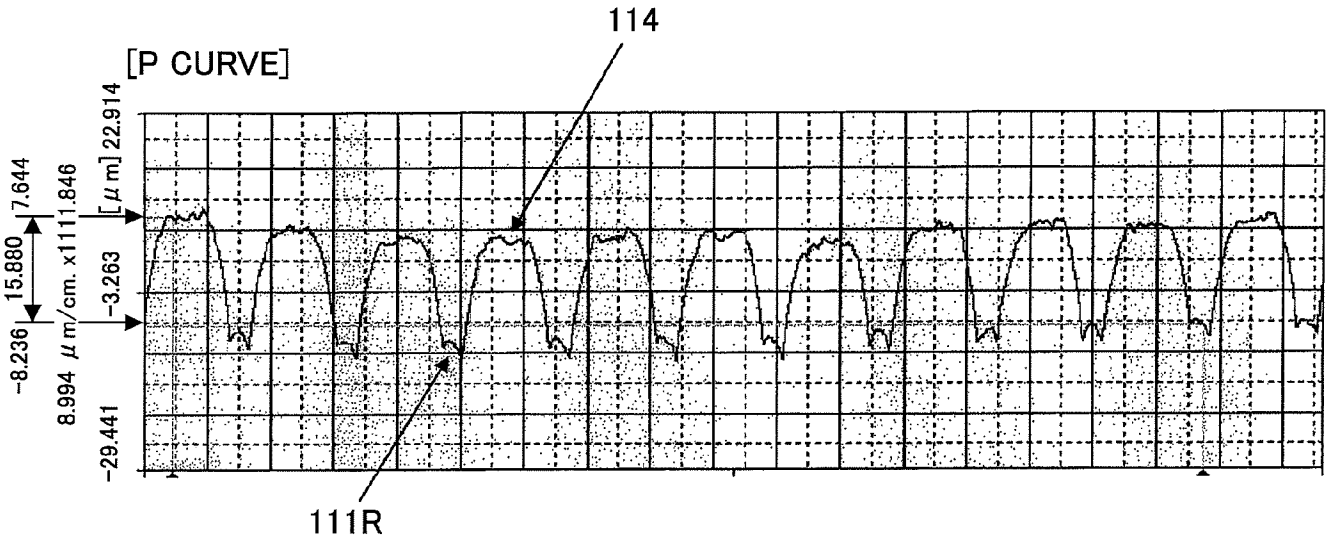
FIG. 31 is a graph of surface roughness measured after forming the projections illustrated in FIG. 30.

FIG. 31 illustrates a measurement result of surface roughness of the actually worked tape-like member 111 with the use of a contact-type surface roughness meter. It is seen from FIG. 31 that the side 111R reverse of the side from which the tape-like member 111 has been pressed has a smaller sliding surface area.

Thus, the separation members, the separation devices, the fixing devices, and the image forming apparatuses have been described in the embodiments. However, the present invention is not limited to these embodiments, and various modifications and alterations can be made within the scope of the present invention described in the claims.

What is claimed is:

1. A separator to separate a conveyance object from two rotation bodies, the conveyance object having been sent out from a nip that is formed by the two rotation bodies that are in contact with one another, the separator comprising:

a wavy part directed toward the nip and inclined from a normal to a center line of the two rotation bodies at a predetermined angle, wherein the wavy part covers a contact zone where the conveyance object can come into contact with the separator along a conveyance direction and along a width direction of the conveyance object, and the wavy part has a plurality of depressions parallel to each other and extending in a direction inclined from the conveyance direction and inclined from the width direction, at least two of the depressions overlapping along the conveyance direction, and the wavy part has a plurality of projections formed between the grooves, the projections having smoothly curved surfaces.

2. The separator according to claim 1, further comprising a surface layer member formed on a surface of an extending end of the separator directed toward the nip, the surface layer member having slidability higher than slidability of a body of the separator, wherein the wavy part comprises the surface layer member.

3. The separator according to claim 1, wherein the depressions of the wavy part that are adjacent to each other have segments that overlap along a direction perpendicular to the conveyance direction.

4. The separator according to claim 1, wherein the depressions that are adjacent to each other overlap along the conveyance direction within the contact zone.

5. The separator according to claim 1, wherein the predetermined angle falls within 10 degrees from the normal on a side opposite a side on which an image is formed on the conveyance object.

6. The separator according to claim 1, wherein the predetermined angle is parallel to the conveyance direction of the nip.

7. The separator according to claim 1, wherein depths of the depressions are greater than or equal to 7.3 μm.

8. The separator according to claim 1, wherein depths of the depressions are less than or equal to 38 μm.

9. The separator according to claim 1, wherein a separator upstream section has a shallow groove section where depths of the depressions are smaller than depths of the depressions of a separator midstream section, where the separator upstream section is a section of the separator facing the nip, a separator downstream section is a section of the separator opposite the separator upstream side, and the separator midstream section is a section of the separator between the separator upstream section and the separator downstream section.

10. The separator according to claim 9, wherein depths of the shallow groove section are less than or equal to 3 μm.

11. The separator according claim 1, wherein the depressions have intervals less than or equal to 1.2 mm.

12. A fixing device that comprises the two rotation bodies that form the nip and the separator according to claim 1 on a downstream side of the nip with respect to the conveyance direction.

13. The fixing device according to claim 12, wherein the two rotation bodies and the separator are arranged in such a manner that a gap between the two rotation bodies and the separator is greater at an end than a center with respect to the width direction of the separator.

14. An image forming apparatus that comprises the fixing device according to claim 12.

15. An image forming apparatus that comprises the separator according to claim 1 and the two rotation bodies that form the nip, the image forming apparatus forming an image on the conveyance object as a recording medium.

* * * * *